US009889998B2

(12) United States Patent
Oki et al.

(10) Patent No.: US 9,889,998 B2
(45) Date of Patent: Feb. 13, 2018

(54) RECORDING APPARATUS WITH MOVABLE FEED ROLLER

(71) Applicant: SEIKO EPSON CORPORATION, Tokyo (JP)

(72) Inventors: Narihiro Oki, Matsumoto (JP); Kazuo Otsuka, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/295,642

(22) Filed: Oct. 17, 2016

(65) Prior Publication Data

US 2017/0113472 A1 Apr. 27, 2017

(30) Foreign Application Priority Data

Oct. 21, 2015 (JP) ..... 2015-206995

(51) Int. Cl.

| | |
|---|---|
| ***B65H 1/04*** | (2006.01) |
| ***B65H 1/26*** | (2006.01) |
| ***B65H 3/06*** | (2006.01) |
| ***B65H 3/44*** | (2006.01) |
| ***B65H 7/18*** | (2006.01) |

(52) U.S. Cl.

CPC ..... *B65H 1/04* (2013.01); *B65H 1/26* (2013.01); *B65H 3/0669* (2013.01); *B65H 3/0684* (2013.01); *B65H 3/44* (2013.01); *B65H 7/18* (2013.01); *B65H 2403/513* (2013.01); *B65H 2404/1531* (2013.01); *B65H 2405/114* (2013.01); *B65H 2405/332* (2013.01); *B65H 2511/20* (2013.01); *B65H 2511/214* (2013.01);

(Continued)

(58) Field of Classification Search

CPC ... B41J 11/58; B65H 1/04; B65H 7/18; B65H 3/44; B65H 3/0684; B65H 3/0669; B65H 1/26; B65H 2801/39; B65H 2403/513; B65H 2511/214; B65H 2511/20; B65H 2405/332; B65H 2405/114; B65H 2404/1531; B65H 2801/12

See application file for complete search history.

(56) References Cited

U.S. PATENT DOCUMENTS 5,622,364 A * 4/1997 Dutton ..... B65H 7/00 271/110

7,694,950 B2 4/2010 Shiohara et al.

(Continued)

FOREIGN PATENT DOCUMENTS

| | | |
|---|---|---|
| JP | 4706657 | 10/2008 |
| JP | 2006-273565 | 6/2015 |

*Primary Examiner* — Henok Legesse

(74) *Attorney, Agent, or Firm* — Workman Nydegger

(57) ABSTRACT

A recording apparatus includes a recording unit which performs recording on a recording medium, a tray which stores the recording medium, a tray storage portion which stores the tray, a feed roller which feeds the recording medium out from the tray, and a roller support member which supports the feed roller and causes the feed roller to be lifted and lowered in relation to the tray by changing posture, in which a cam shaft capable of rotating is provided in the tray storage portion, in which the cam shaft is provided with a first engaging portion which engages with the tray and a second engaging portion which engages with the roller support member, and in which the roller support member is configured to change posture due to the tray causing the cam shaft to rotate.

8 Claims, 33 Drawing Sheets

(52) U.S. Cl.
CPC ..... *B65H 2801/12* (2013.01); *B65H 2801/39* (2013.01)

(56) References Cited

U.S. PATENT DOCUMENTS

| | | | | |
|---|---|---|---|---|
| 7,963,517 | B2 | 6/2011 | Shiohara et al. | |
| 8,342,502 | B2 | 1/2013 | Shiohara et al. | |
| 8,342,503 | B2 | 1/2013 | Shiohara et al. | |
| 8,517,370 | B2 | 8/2013 | Shiohara et al. | |
| 8,714,540 | B2 | 5/2014 | Shiohara et al. | |
| 8,967,614 | B2 | 3/2015 | Shiohara et al. | |
| 2005/0140081 | A1* | 6/2005 | Sugimura ..... | B65H 1/04 271/118 |
| 2015/0166278 | A1 | 6/2015 | Shiohara et al. | |

* cited by examiner

RECORDING APPARATUS WITH MOVABLE FEED ROLLER

BACKGROUND

1. Technical Field

The present invention relates to a recording apparatus provided with a tray which stores a recording medium, a feed roller which feeds the recording medium from the tray, and a roller support member which supports the feed roller and lifts and lowers the feed roller in relation to the tray.

2. Related Art

In the recording apparatus which is represented by a facsimile, a printer, or the like, a detachable paper feed cassette in relation to the apparatus main body is widely used in the related art. There are various names, such as "cassette" and "tray", for a detachable paper storage implement which stores paper in the recording apparatus, and in the present specification, either term will be used according to the situation.

A configuration is well known in which a paper feed roller is provided above the paper feed cassette, the paper feed roller is supported by an arm (a support member), and the paper feed roller is lifted and lowered in relation to the recording medium which is stored in the paper feed cassette. Furthermore, a configuration is well known in which a plurality of paper feed cassettes are provided, and a paper feeding operation from any of the paper feed cassettes is selectively performed by one paper feed roller.

Incidentally, in a configuration in which the paper feed roller is supported by an arm, a configuration which takes into account the arm coming into contact with the paper feed cassette during the insertion and removal of the paper feed cassette becomes necessary.

JP-A-2006-273565 discloses a configuration in which a cam is provided on the paper feed cassette side, a cam follower is provided on a paper feed unit (an arm) side, and through the engagement of the cam and the cam follower, the paper feed roller is lifted and lowered during the insertion and removal of the paper feed cassette.

As described in JP-A-2006-273565, in the configuration in which the paper feed unit (the arm) is lifted and lowered by the paper feed cassette, there is a case in which a large operational force becomes necessary depending on the force which the paper feed cassette receives from the paper feed unit (the arm). For example, when the user inserts the paper feed cassette, the user perceives a large resistance force, and operational comfort of the user may be reduced.

It is possible to adjust the operational force when lifting and lowering the paper feed unit (the arm) using the paper feed cassette in the configuration described in JP-A-2006-273565 by changing the engagement position between the paper feed cassette and the paper feed unit (the arm); however, since the paper feed cassette in the configuration described in JP-A-2006-273565 is configured to directly push the paper feed unit (the arm) upward, there is a problem in that freedom in adjustment may not be secured due to space concerns.

SUMMARY

An advantage of some aspects of the invention is to provide a recording apparatus which takes usability into account when inserting and removing a tray which stores paper.

According to an aspect of the invention, a recording apparatus includes a recording unit which performs recording on a recording medium, a tray which stores the recording medium, a tray storage portion which stores the tray, a feed roller which feeds the recording medium out from the tray, and a roller support member which supports the feed roller and causes the feed roller to be lifted and lowered in relation to the tray by changing posture, in which a cam shaft capable of rotating is provided in the tray storage portion, in which the cam shaft is provided with a first engaging portion which engages with the tray and a second engaging portion which engages with the roller support member, and in which the roller support member is configured to change posture due to the tray causing the cam shaft to rotate.

According to this aspect, the cam shaft which is capable of rotating is provided in the tray storage portion which stores the tray, and the cam shaft is provided with the first engaging portion which engages with the tray, and the second engaging portion which engages with the roller support member which supports the feed roller. Since the roller support member is configured to change posture due to the tray causing the cam shaft to rotate, it is possible to easily adjust the operational force when changing the posture of the roller support member using the tray by adjusting the engagement between the first engaging portion and the tray and the engagement between the second engaging portion and the roller support member. In other words, it is possible to secure freedom in the adjustment.

In the recording apparatus, the roller support member may be configured to be provided to be capable of rocking centered on a rocking shaft and to cause the feed roller to be lifted or lowered in relation to the tray by rocking, and the cam shaft may be a separate member from the rocking shaft.

According to this aspect, since the cam shaft is a separate member from the rocking shaft, it is possible to secure a greater degree of freedom in the setting of the engagement position between the first engaging portion and the tray, and the engagement position between the second engaging portion and the roller support member, and by extension, it is possible to provide a recording apparatus which further takes usability into account.

In the recording apparatus, the cam shaft may be positioned on an insertion direction side of the tray in relation to the rocking shaft in the insertion-removal direction of the tray in relation to the tray storage portion.

According to this aspect, since the cam shaft is positioned on an insertion direction side of the tray in relation to the rocking shaft in the insertion-removal direction of the tray in relation to the tray storage portion, it is possible to separate the engagement position of the roller support member and the second engaging portion in the insertion direction of the tray from the rocking shaft, and by extension, it is possible to push the roller support member upward with a smaller operational force. Detailed description will be given below.

In the recording apparatus, a distance from an engagement position between the tray and the first engaging portion to a rotational center of the cam shaft may be longer than a distance from an engagement position between the roller support member and the second engaging portion to the rotational center.

According to this aspect, since the distance from the engagement position between the tray and the first engaging portion to the rotational center of the cam shaft is longer than the distance from the engagement position between the roller support member and the second engaging portion to the rotational center, it is possible to push the roller support member upward with a smaller operational force using the principle of leverage. Detailed description will be given below.

In the recording apparatus, when the tray pushes the roller support member upward, a height direction displacement amount of the engagement position between the roller support member and the second engaging portion per predetermined rotational angle of the cam shaft may be greater than a height direction displacement amount of the engagement position between the tray and the first engaging portion.

According to this aspect, since when the tray pushes the roller support member upward, the height direction displacement amount of the engagement position between the roller support member and the second engaging portion per predetermined rotational angle of the cam shaft is greater than the height direction displacement amount of the engagement position between the tray and the first engaging portion, it is possible to increase the posture change amount of the roller support member in relation to the displacement amount of the tray. Detailed description will be given below.

In the recording apparatus, a plurality of the trays may be provided.

According to this aspect, in the configuration in which the plurality of trays are provided, it is possible to obtain the same effects as any of the aspects described above.

According to another aspect of the invention, a recording apparatus includes a recording unit which performs recording on a recording medium, a bottom level side tray which stores the recording medium, a top level side tray which is provided above the bottom level side tray and stores the recording medium, a tray storage portion which stores the bottom level side tray and the top level side tray, a feed roller which feeds the recording medium out from the top level side tray and the bottom level side tray, and a roller support member which supports the feed roller and causes the feed roller to be lifted and lowered in relation to the bottom level side tray and the top level side tray by changing posture, in which a cam shaft capable of rotating is provided in the tray storage portion, in which the cam shaft is provided with a first engaging portion which engages with either or both of the bottom level side tray and the top level side tray and a second engaging portion which engages with the roller support member, and in which the roller support member is configured to change posture due to either or both of the bottom level side tray and the top level side tray causing the cam shaft to rotate.

According to this aspect, the cam shaft which is capable of rotating is provided in the tray storage portion which stores the bottom level side tray and the top level side tray (hereinafter shortened to the "top and bottom trays", as appropriate), and the cam shaft is provided with the first engaging portion which engages with either one of the top and bottom trays, and the second engaging portion which engages with the roller support member which supports the feed roller. Since the roller support member is configured to change posture due to either one of the top and bottom trays causing the cam shaft to rotate, it is possible to easily adjust the operational force when either or both of the top and bottom trays causes the posture of the roller support member to change by adjusting the engagement between the first engaging portion and either one of the top and bottom trays and the engagement between the second engaging portion and the roller support member.

In the recording apparatus, the first engaging portion may engage with the top level side tray, the cam shaft may be provided with a third engaging portion which engages with the bottom level side tray, and both the bottom level side tray and the top level side tray may be configured to cause the cam shaft to rotate.

According to this aspect, since both the bottom level side tray and the top level side tray are configured to cause the cam shaft to rotate, it is not necessary to provide a dedicated cam shaft for each of the trays, and it is possible to obtain a simplification and a cost reduction in the apparatus configuration.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, description is given of an embodiment of the invention based on the drawings; however, the invention is not limited to the embodiments described hereinafter, may be modified in various ways within the scope of the invention described in claims, and hereinafter, an embodiment of the invention is described assuming that such modifications are included in the invention.

Figure 1:
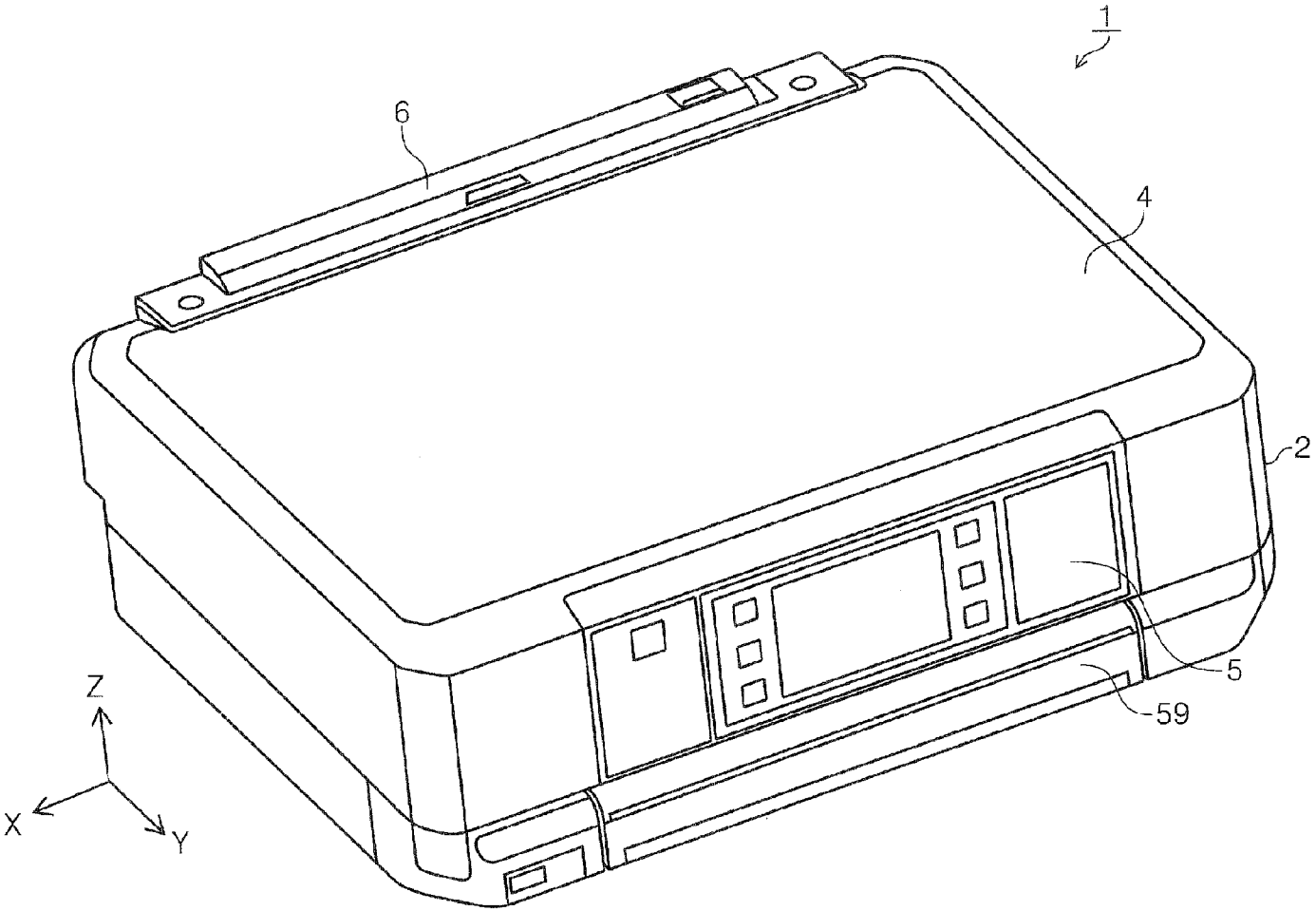
FIG. 1 is an external perspective view of a printer according to the invention.
Figure 2:
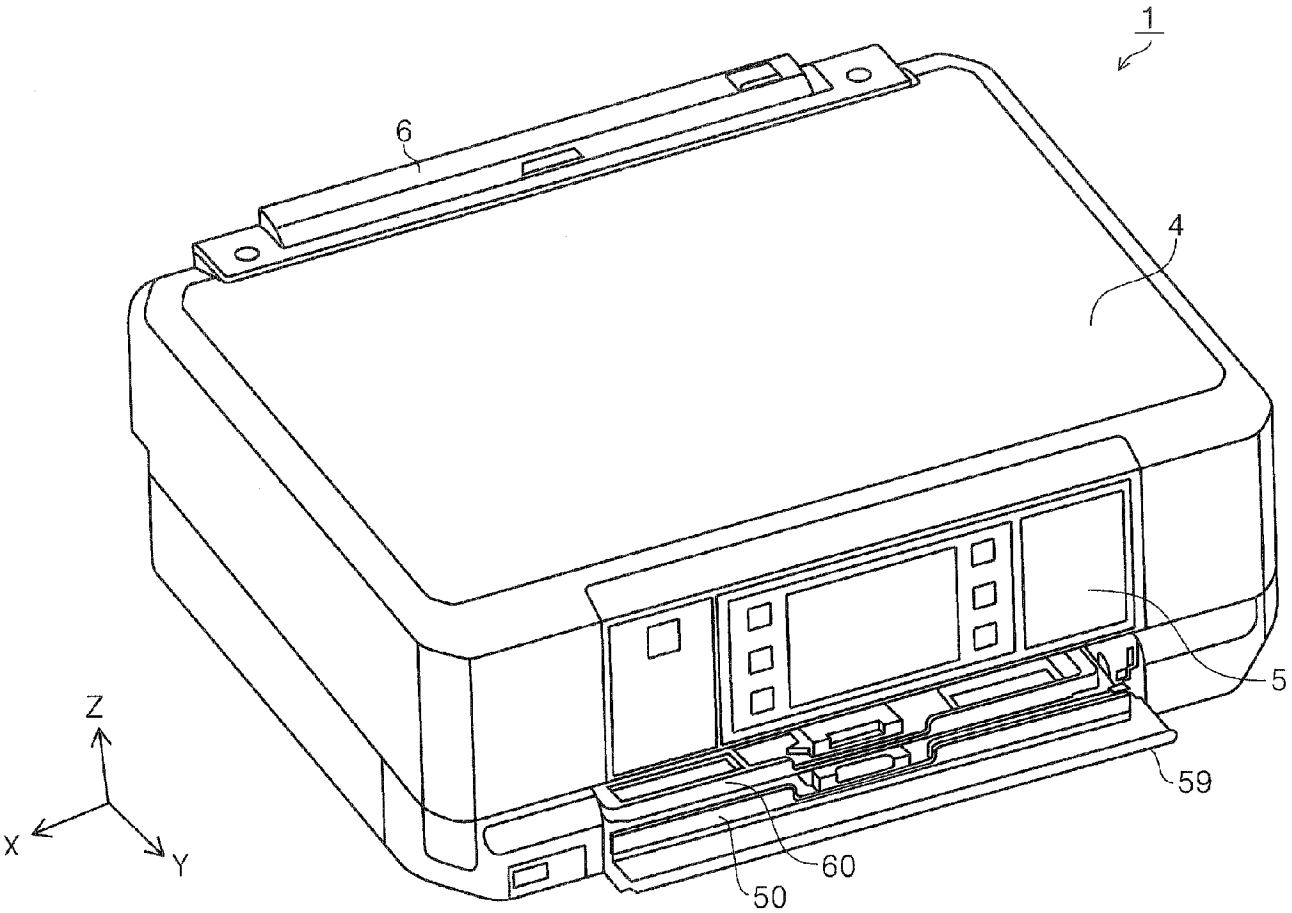
FIG. 2 is an external perspective view of the printer according to the invention.
Figure 3:
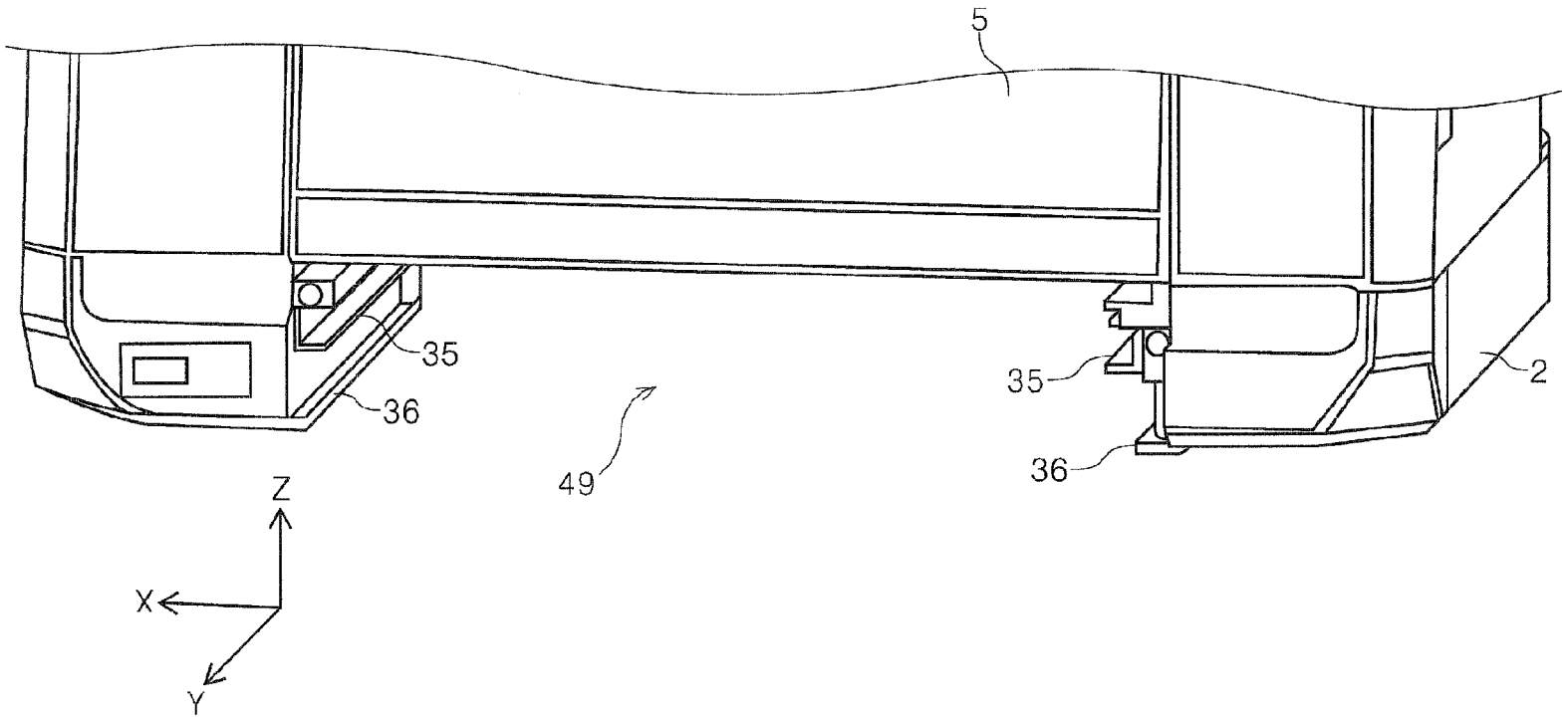
FIG. 3 is an enlarged partial view of an apparatus front surface of the printer according to the invention.
Figure 4:
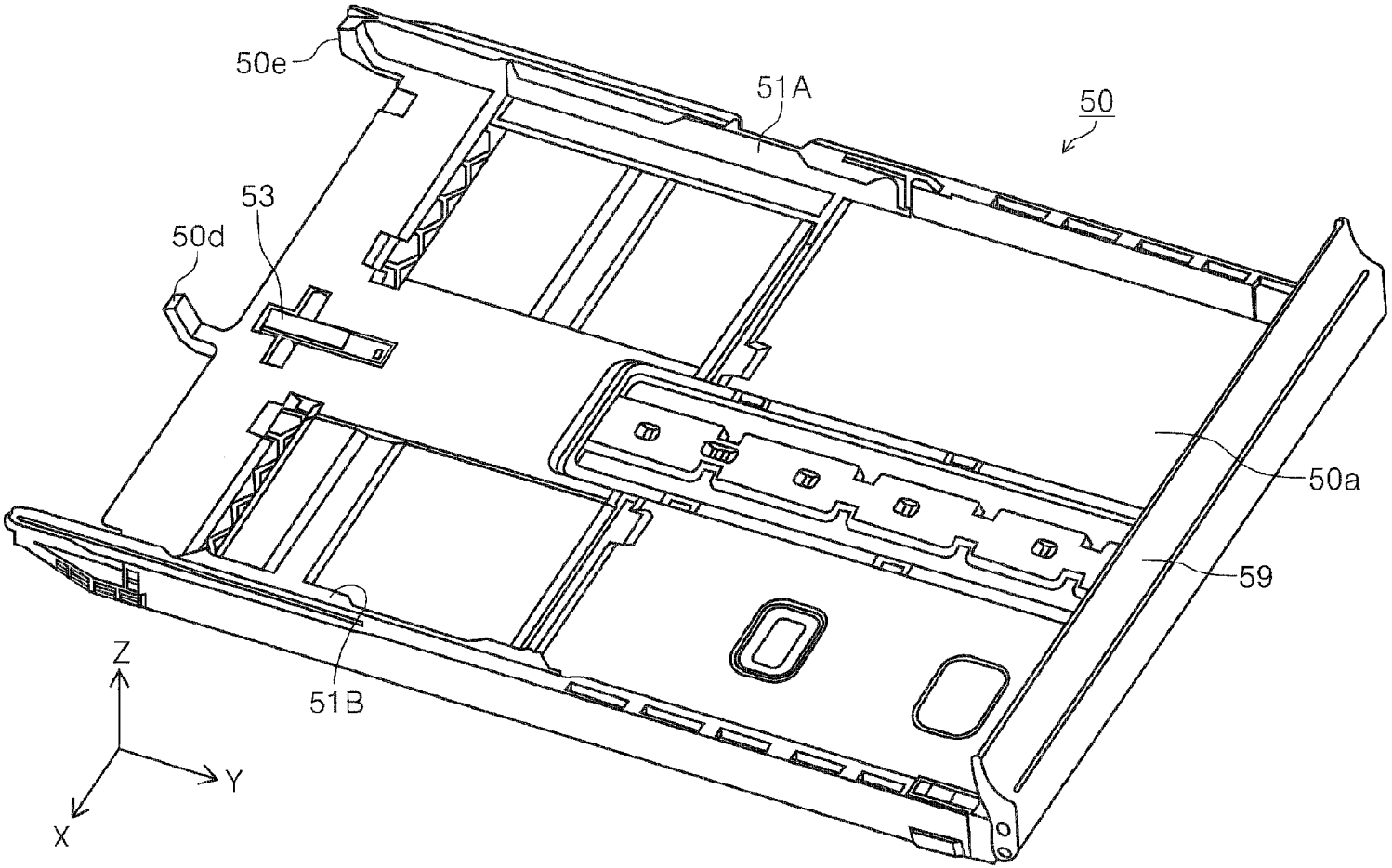
FIG. 4 is a perspective view of a bottom level side tray.
Figure 5:
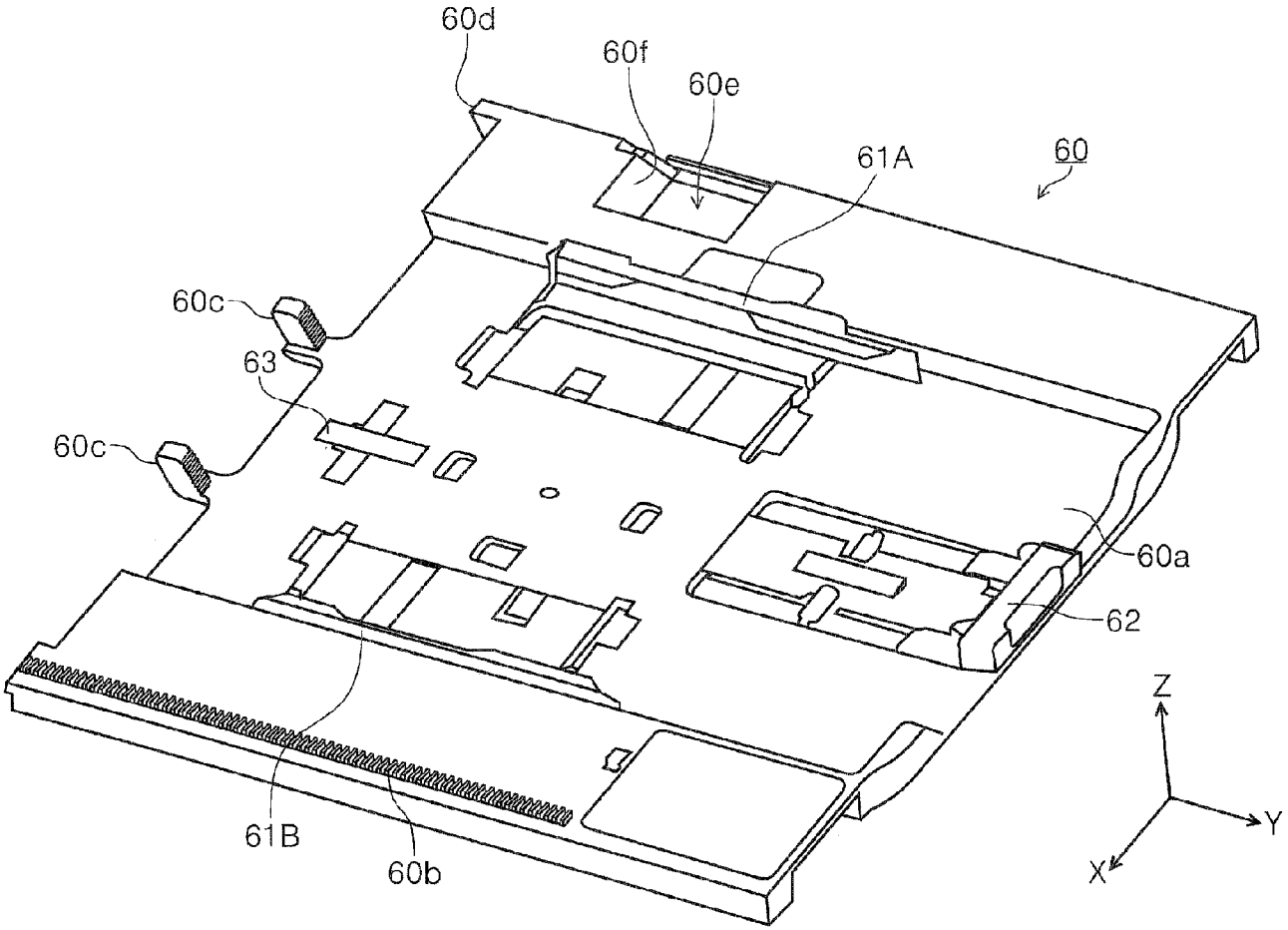
FIG. 5 is a perspective view of a top level side tray.

FIGS. 1 and 2 are external perspective views of an ink jet printer 1 (hereinafter referred to as a "printer") which is an embodiment of a "recording apparatus" according to the invention, FIG. 3 is an enlarged partial view of (a non-mounted state of the top and bottom trays) of an apparatus front surface of the printer 1, FIG. 4 is a perspective view of a bottom level side tray 50, and FIG. 5 is a perspective view of a top level side tray 60.

Figure 6:
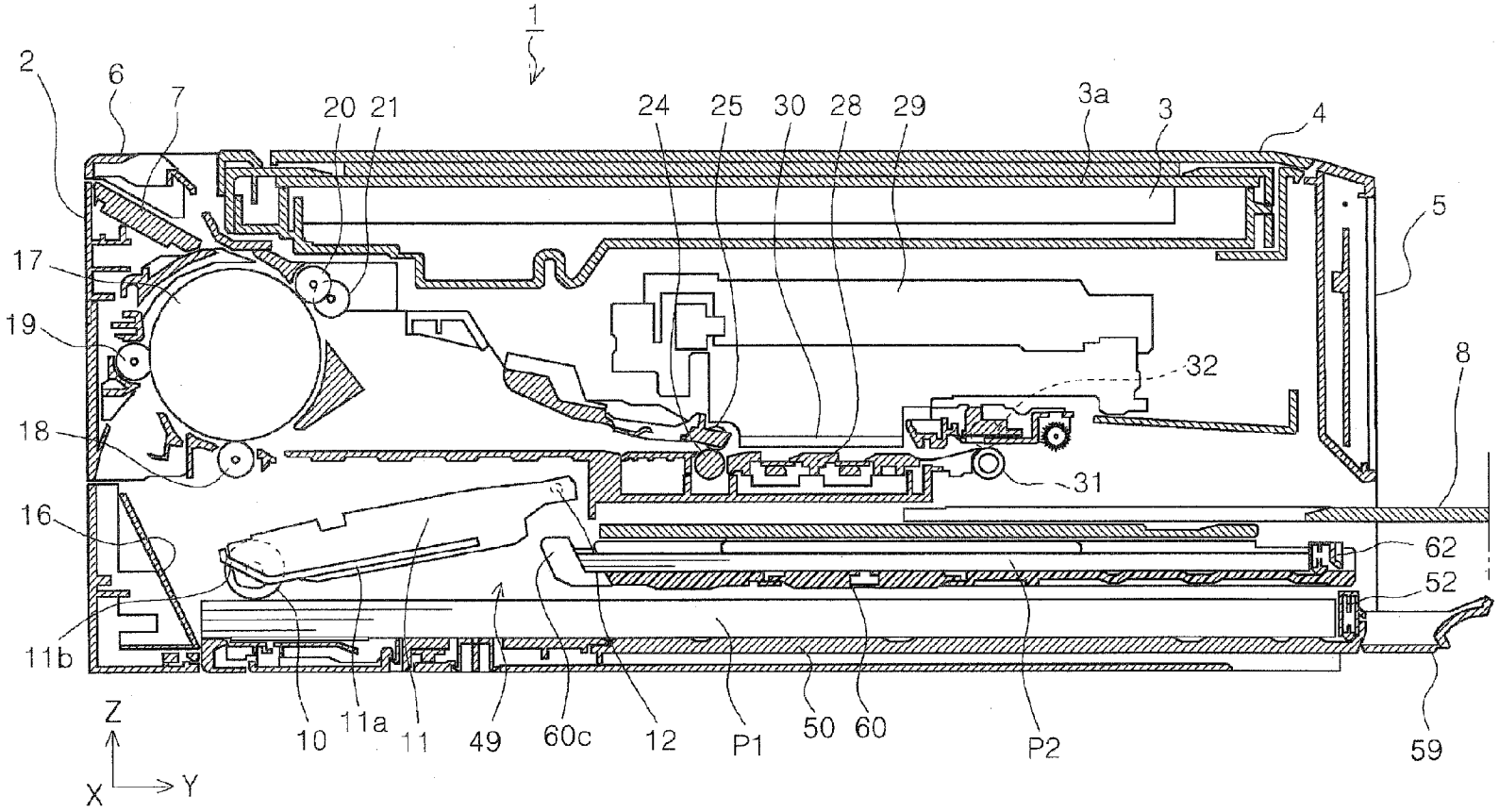
FIG. 6 is a lateral sectional diagram illustrating a paper transport path of the printer according to the invention.
Figure 7:
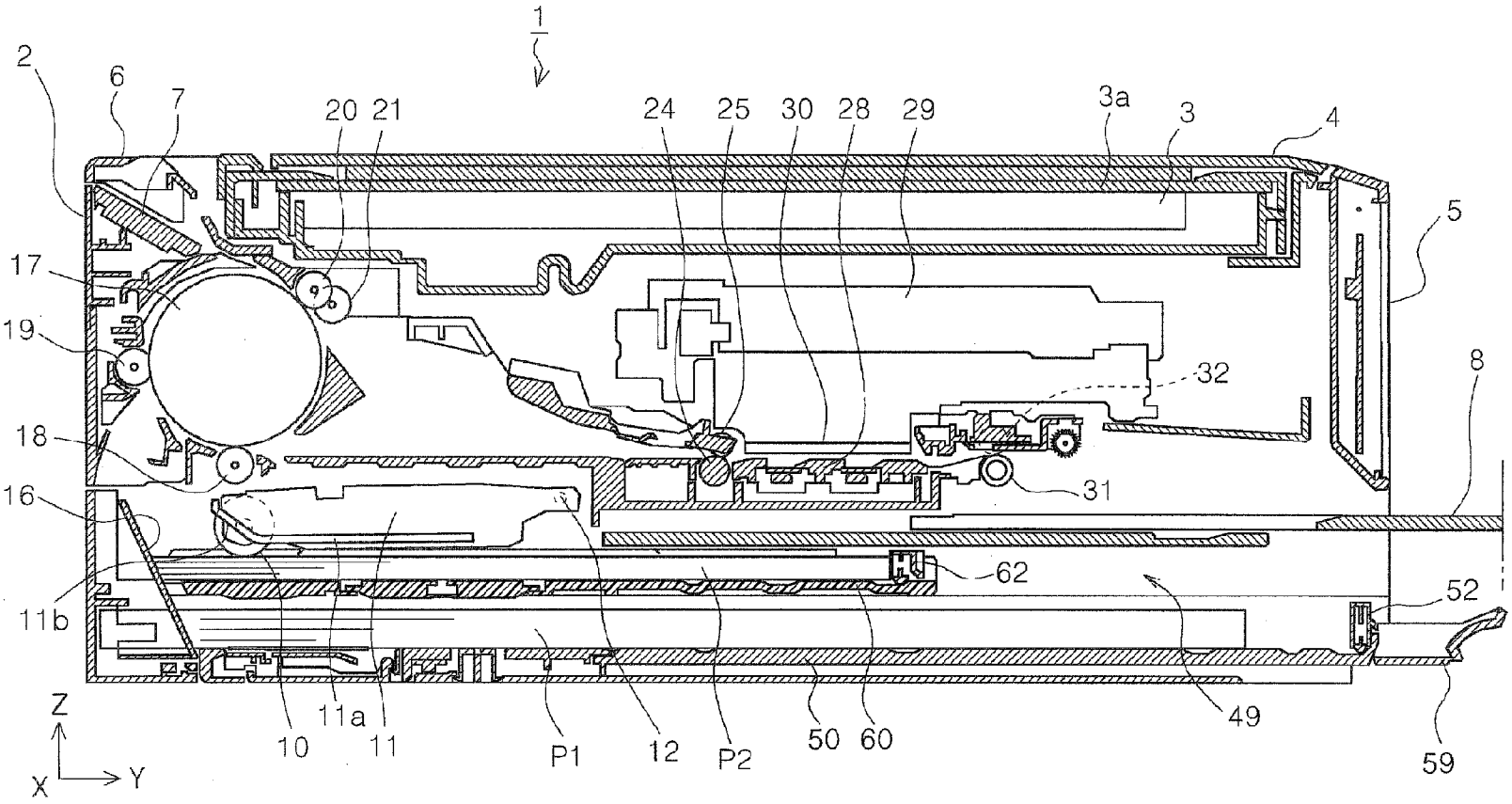
FIG. 7 is a lateral sectional diagram illustrating a paper transport path of the printer according to the invention.
Figure 8:
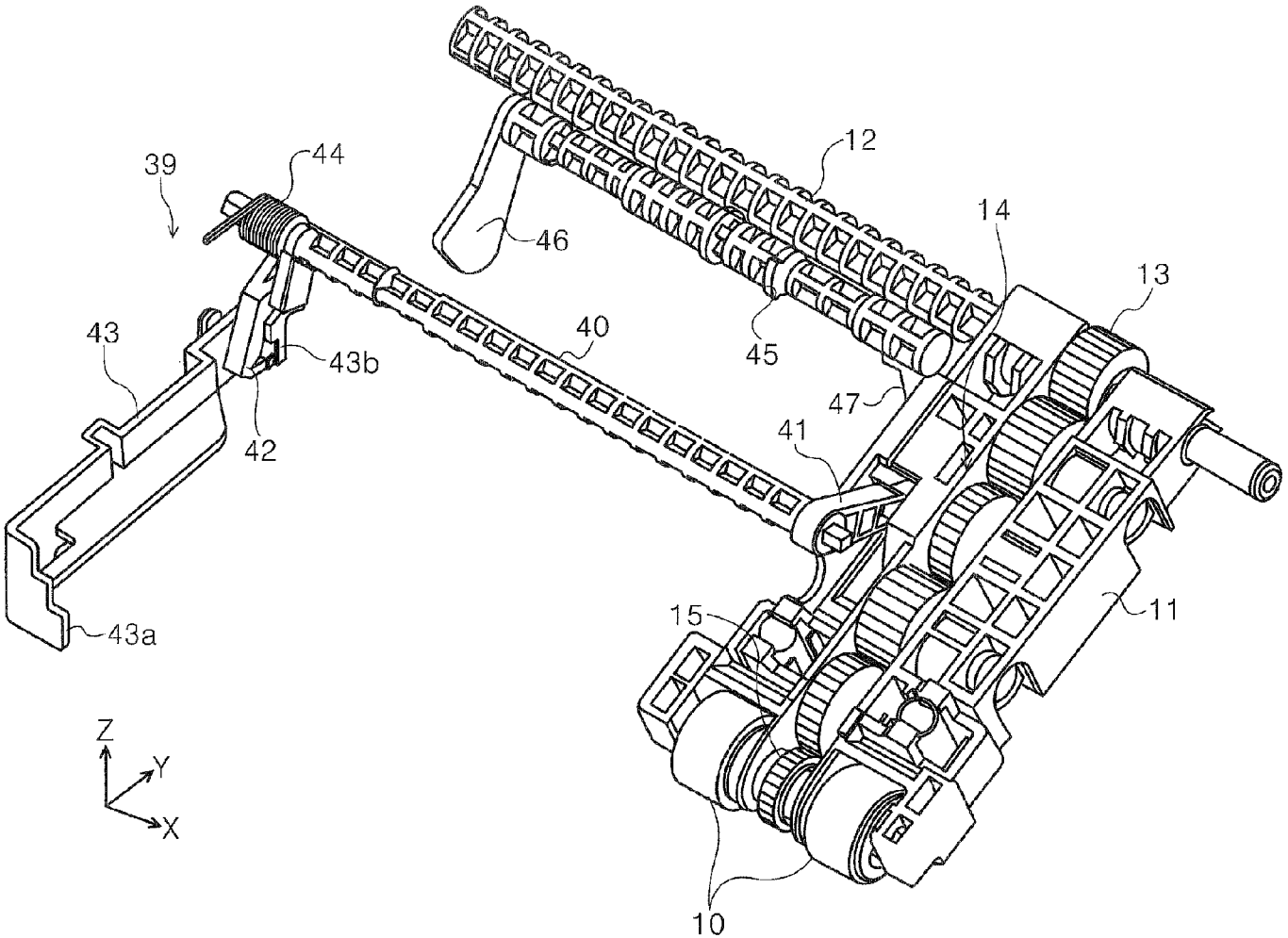
FIG. 8 is a perspective view of a holding unit which holds an intermediate position of a feed roller.
Figure 9:
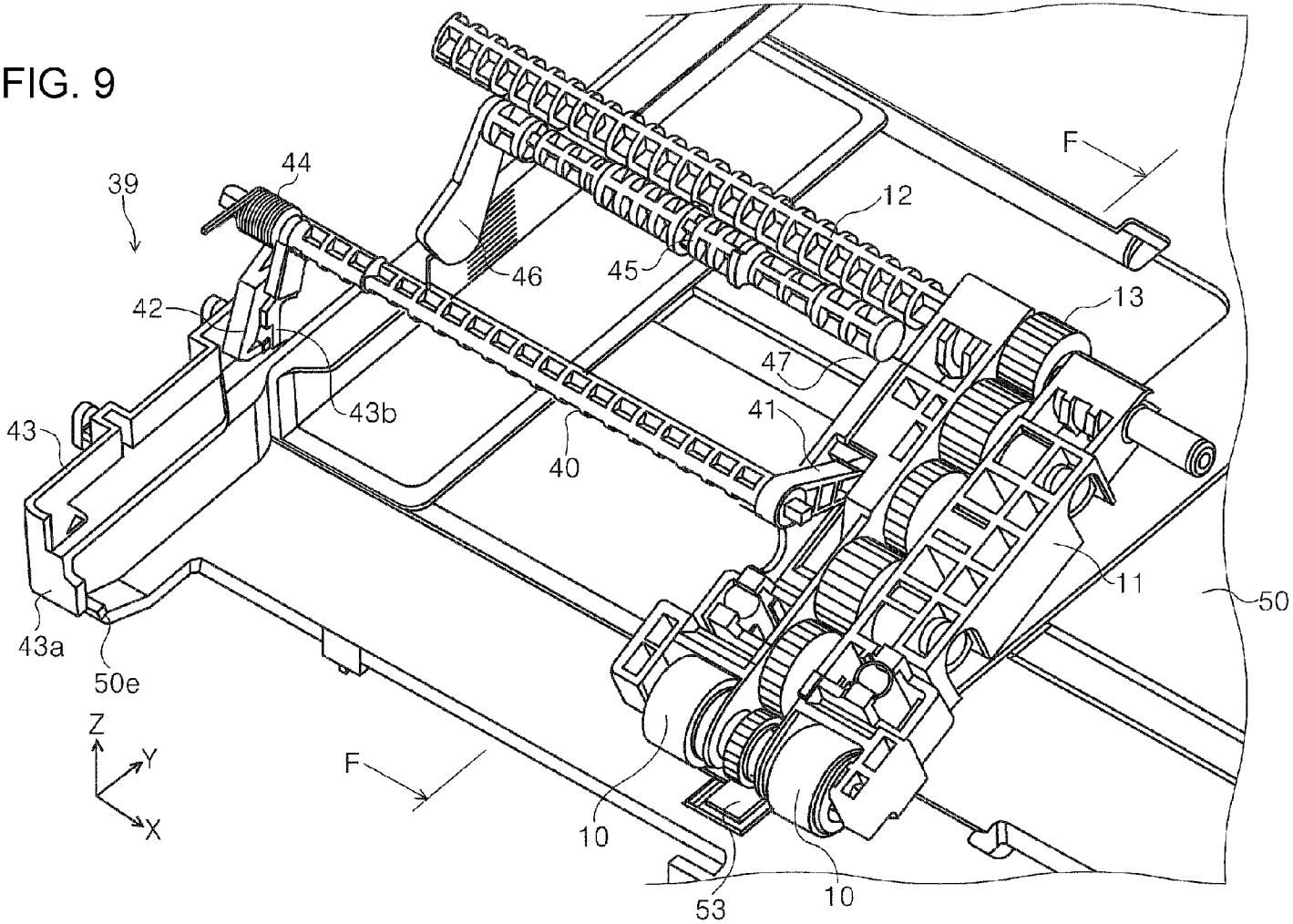
FIG. 9 is a perspective view of the holding unit, which holds the intermediate position of the feed roller, and the bottom level side tray.

FIGS. 6 and 7 are lateral sectional diagrams illustrating the paper transport path of the printer 1, FIG. 8 is a perspective view of a holding unit 39 which holds an intermediate position of a feed roller 10, and FIG. 9 is a perspective view of the holding unit 39 and the bottom level side tray 50.

Figure 10:
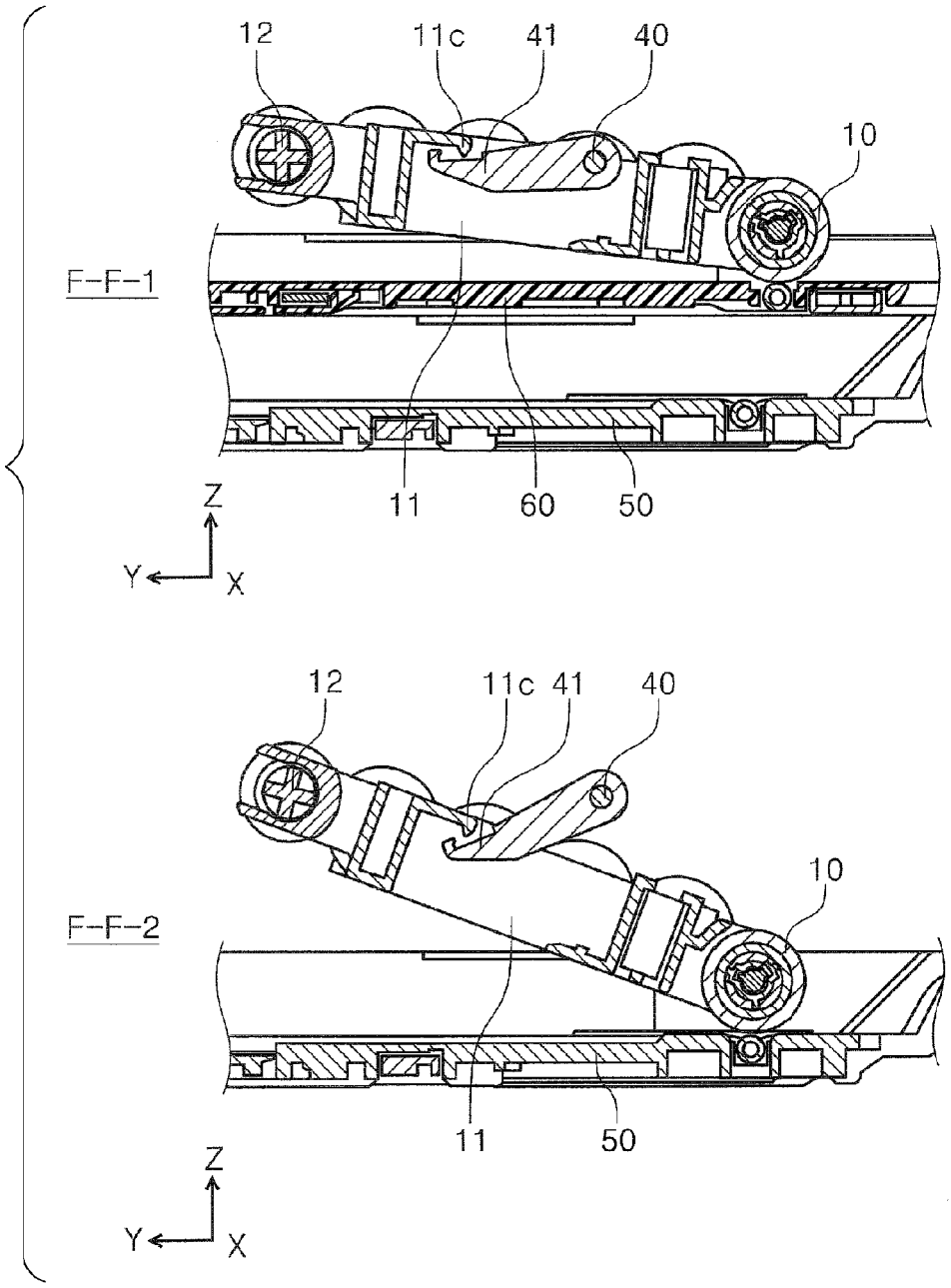
FIG. 10 is a diagram illustrating a state change at cross section F-F of FIG. 9.
Figure 11:
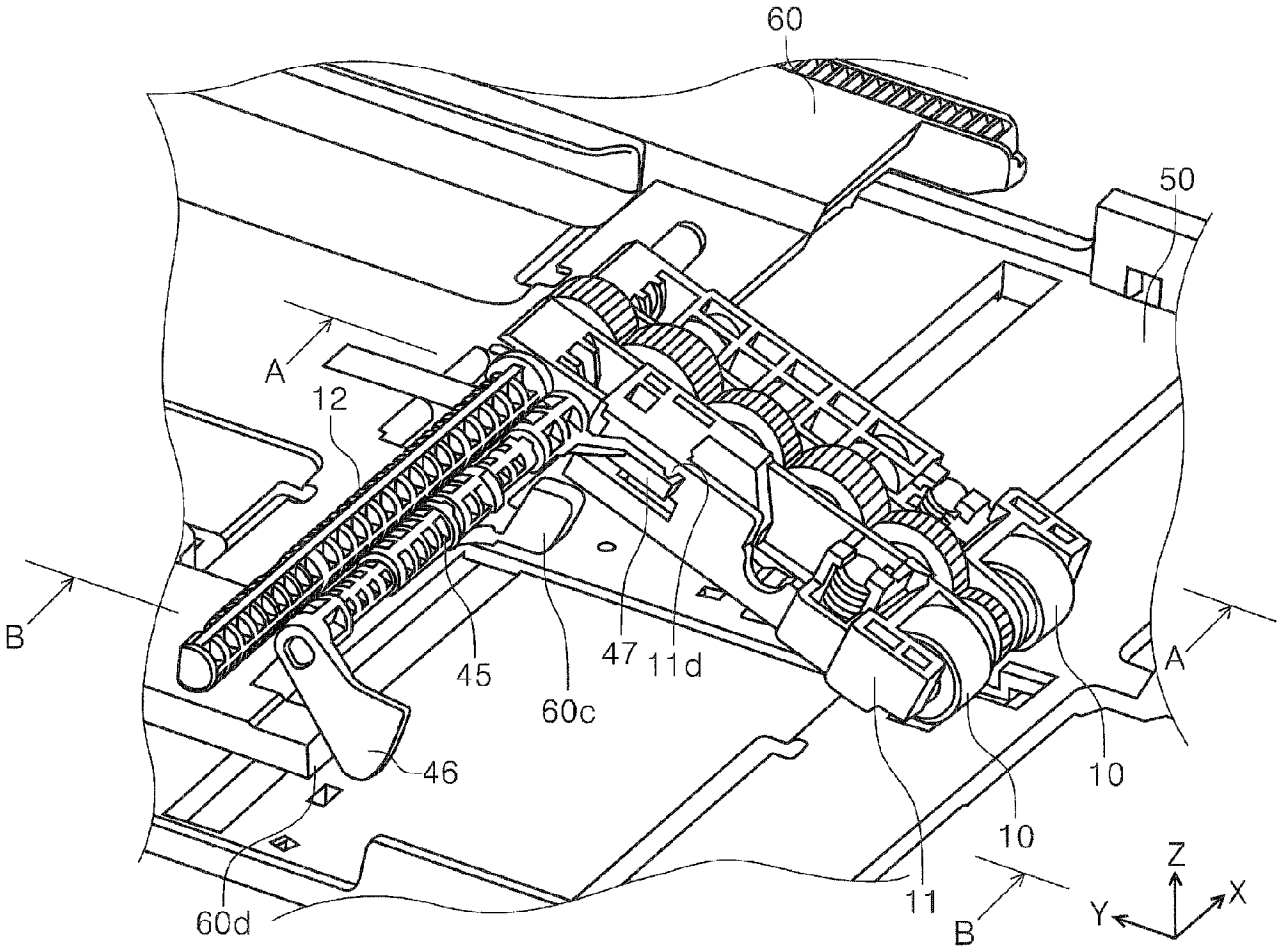
FIG. 11 is a perspective view illustrating a relationship between a cam shaft and the top level side tray.
Figure 17:
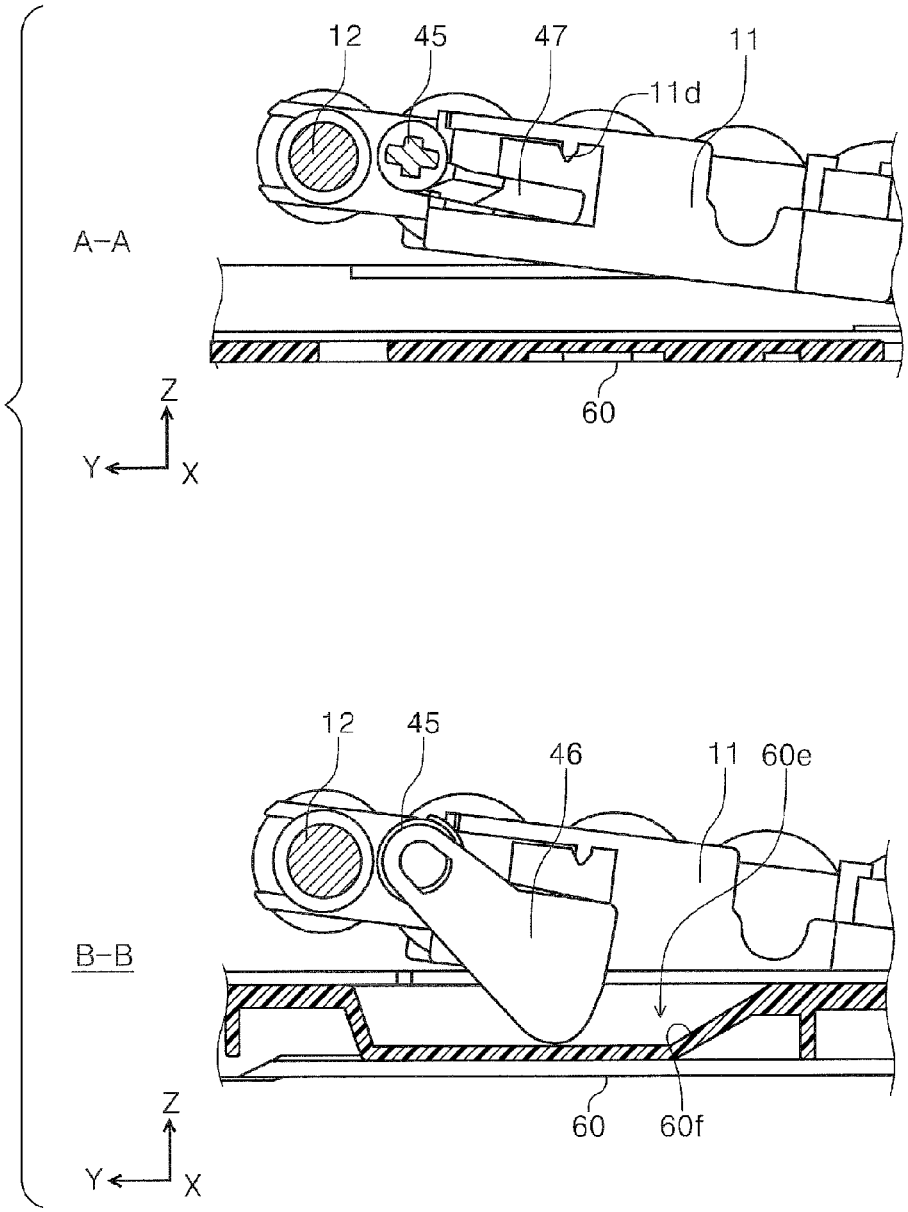
FIG. 17 is a diagram comparatively illustrating cross section A-A and cross section B-B of FIG. 11.
Figure 18:
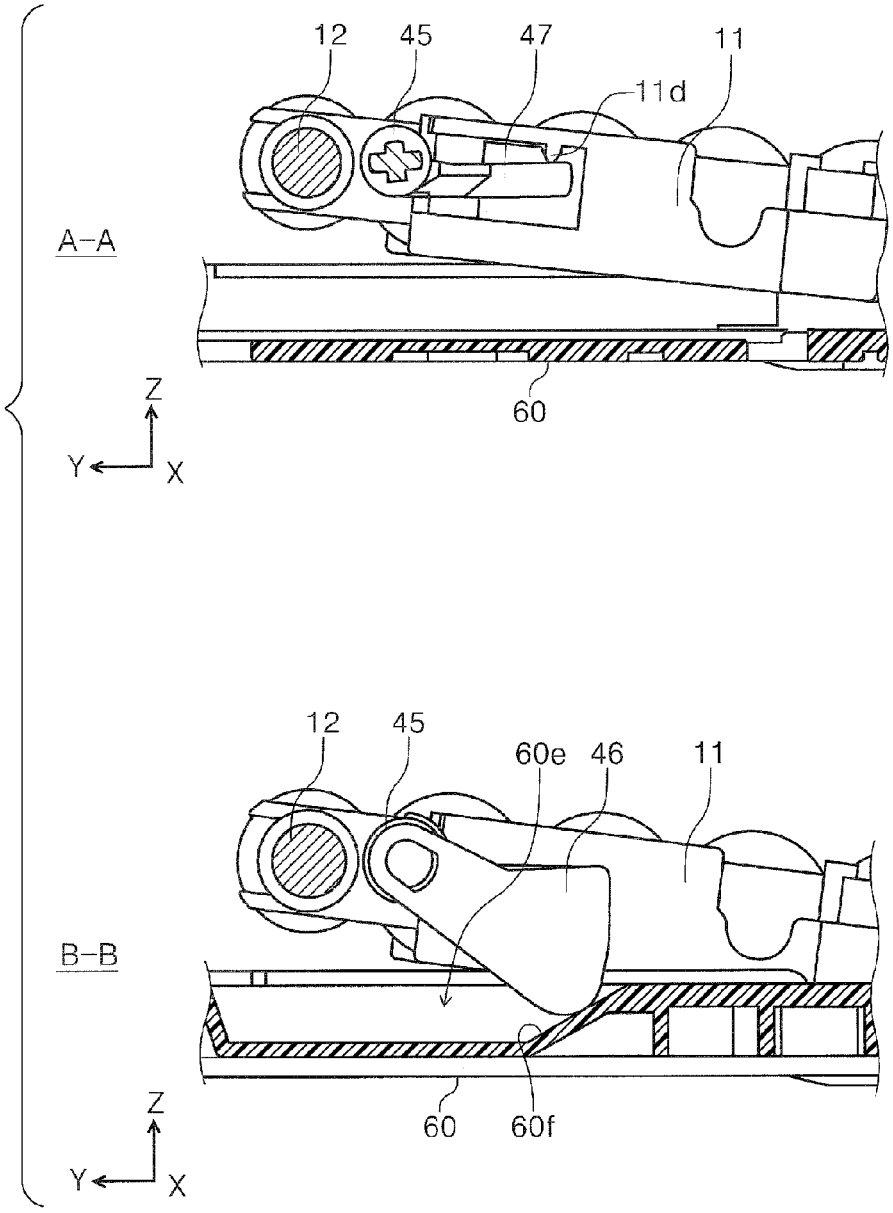
FIG. 18 is a diagram comparatively illustrating cross section A-A and cross section B-B of FIG. 11.
Figure 19:
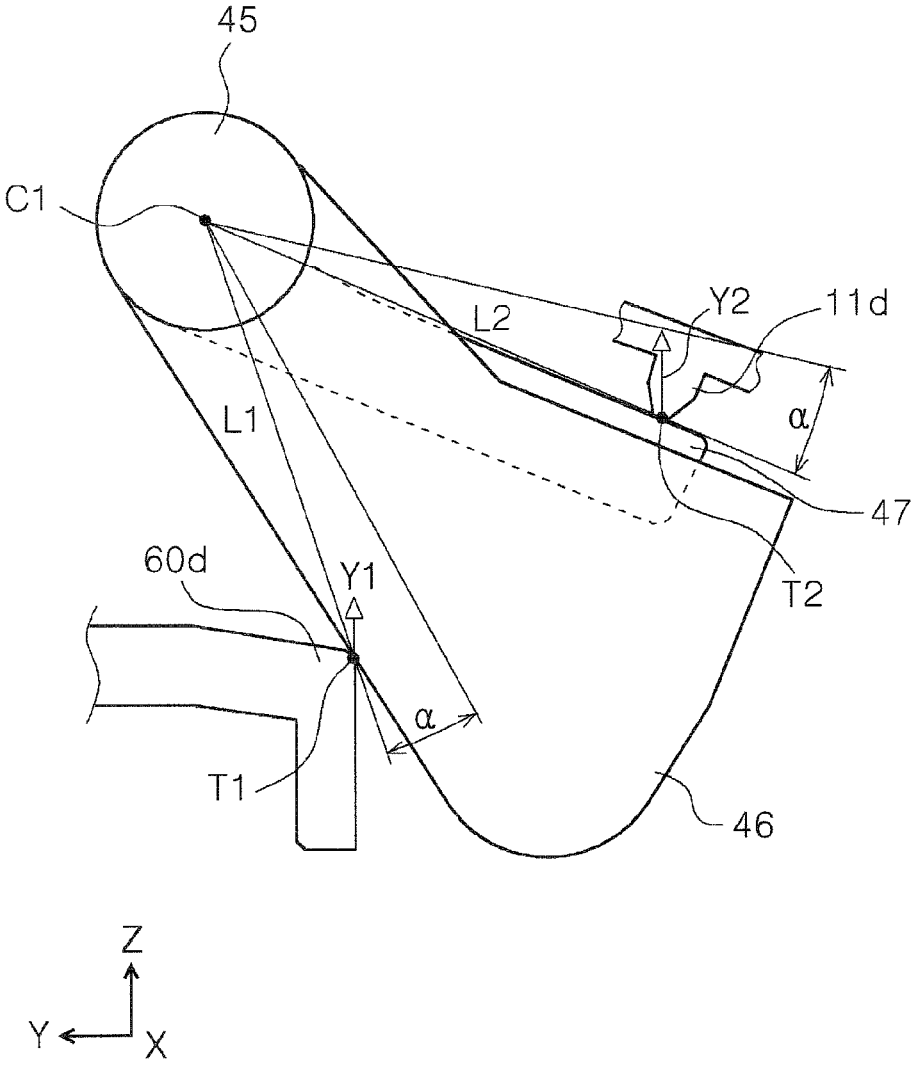
FIG. 19 is a diagram of the cam shaft as viewed from an axial direction.

FIG. 10 is a diagram illustrating a state change at cross section F-F of FIG. 9, FIGS. 11 to 14 are perspective views illustrating a relationship between a cam shaft 45 and the top level side tray 60, FIGS. 15 to 18 are diagrams comparatively illustrating cross section A-A and cross section B-B of FIG. 11, and FIG. 19 is a diagram of the cam shaft 45 as viewed from an axial direction.

Figure 20:
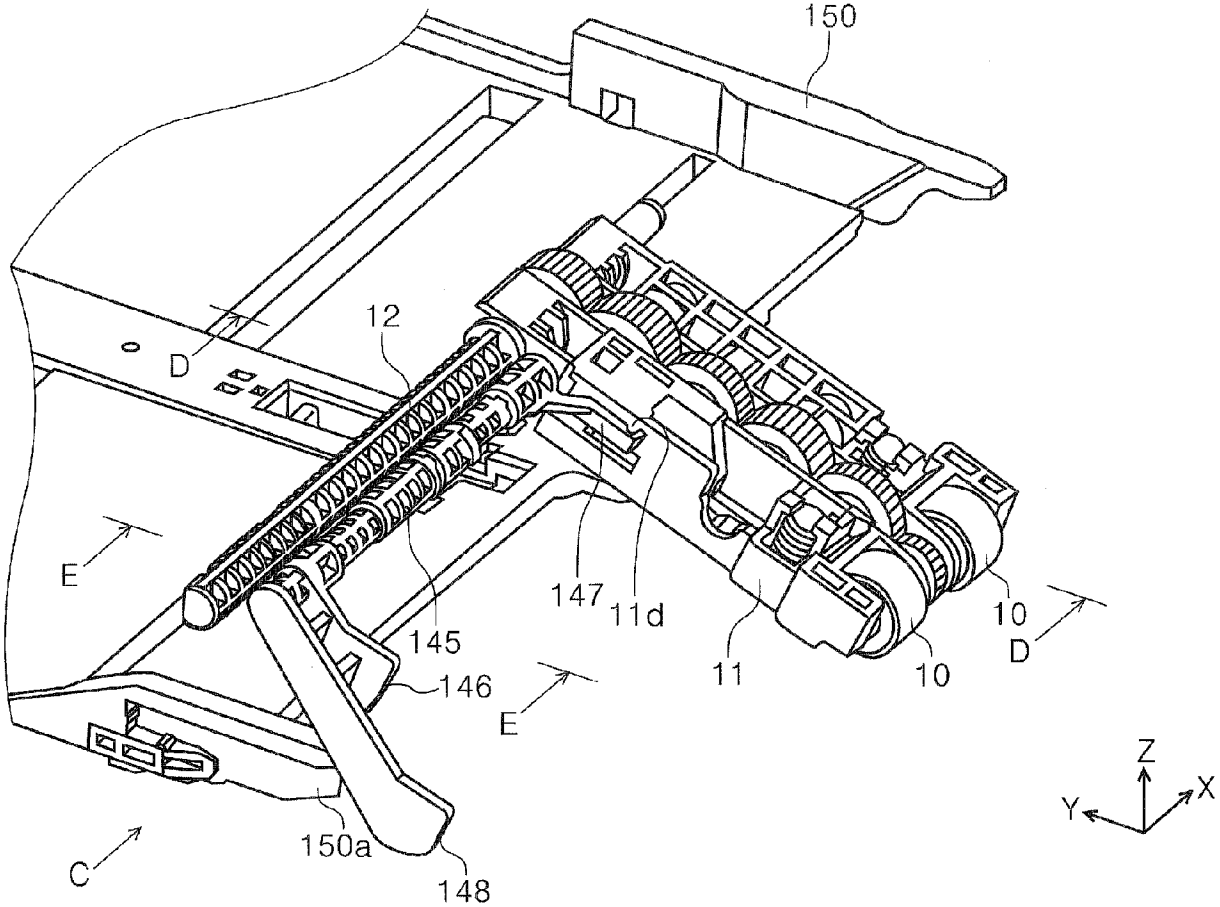
FIG. 20 is a perspective view illustrating a cam shaft and a bottom level side tray according to a second embodiment.
Figure 21:
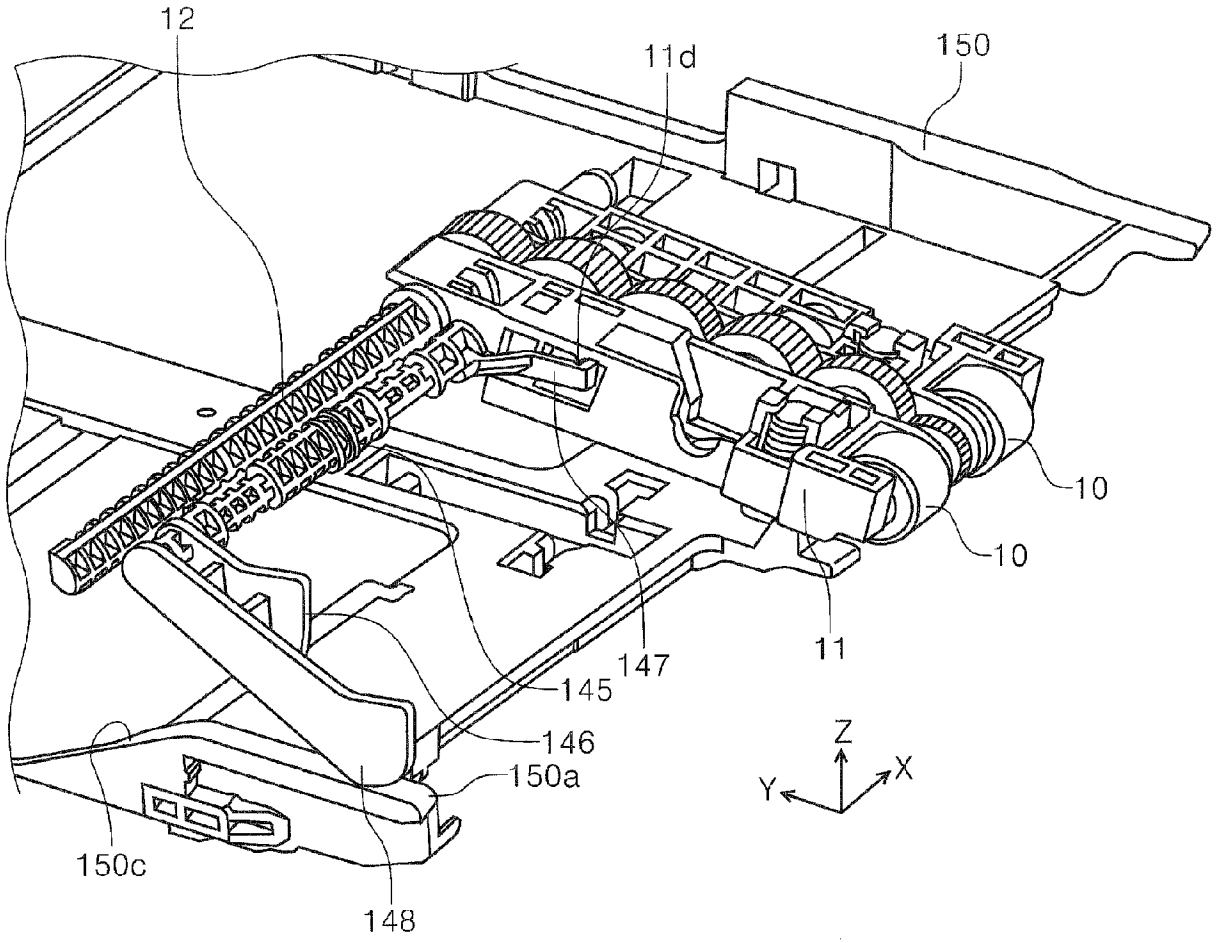
FIG. 21 is a perspective view illustrating the cam shaft and the bottom level side tray according to the second embodiment.
Figure 22:
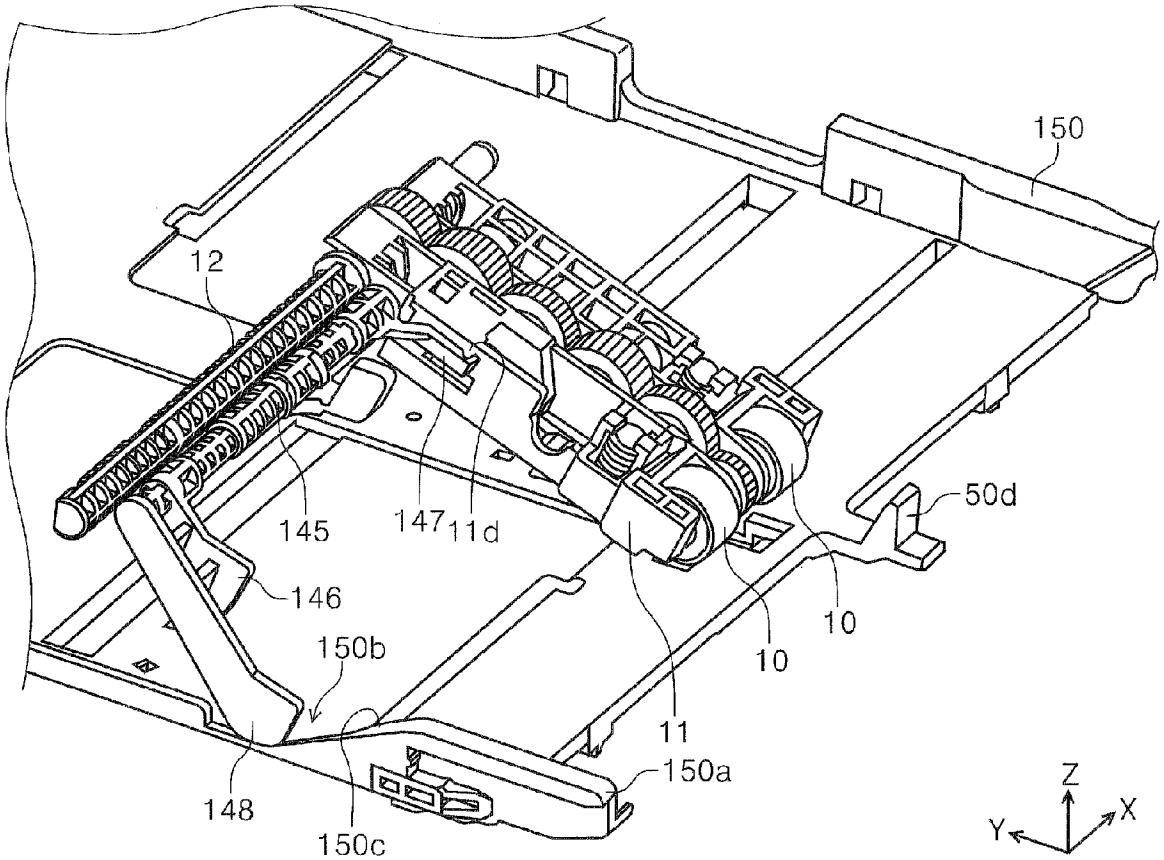
FIG. 22 is a perspective view illustrating the cam shaft and the bottom level side tray according to the second embodiment.
Figure 23:
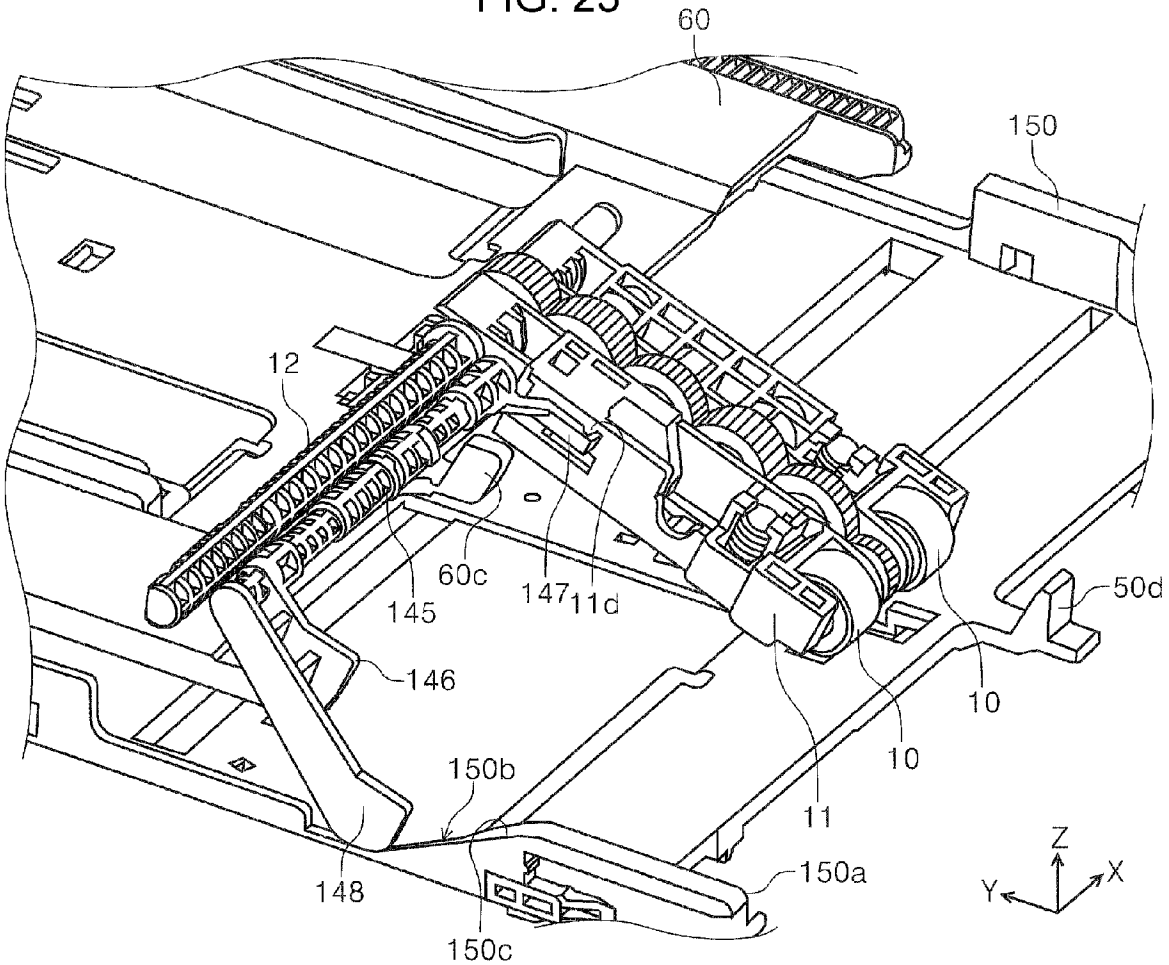
FIG. 23 is a perspective view illustrating the cam shaft, the bottom level side tray, and a top level side tray according to the second embodiment.
Figure 24:
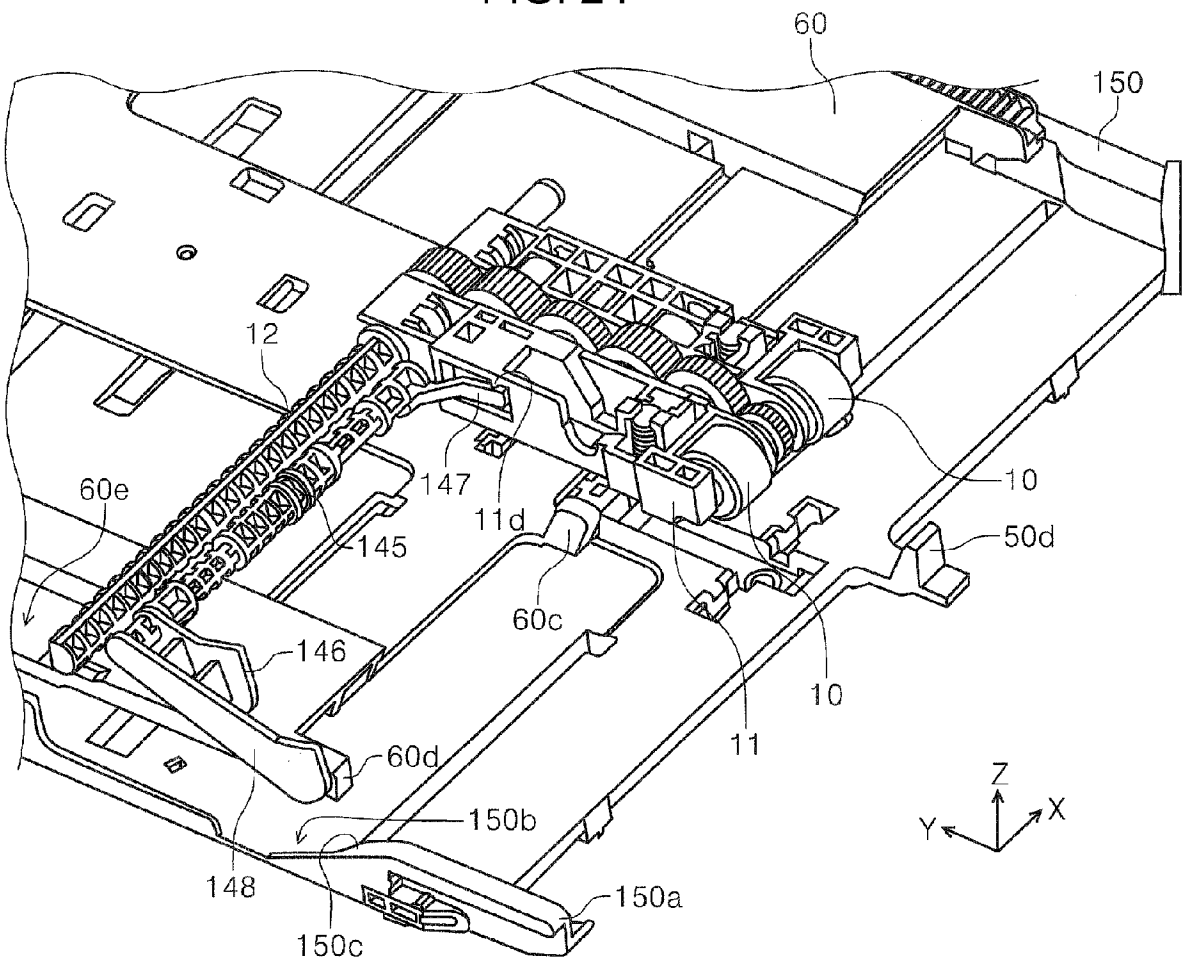
FIG. 24 is a perspective view illustrating the cam shaft, the bottom level side tray, and a top level side tray according to the second embodiment.
Figure 25:
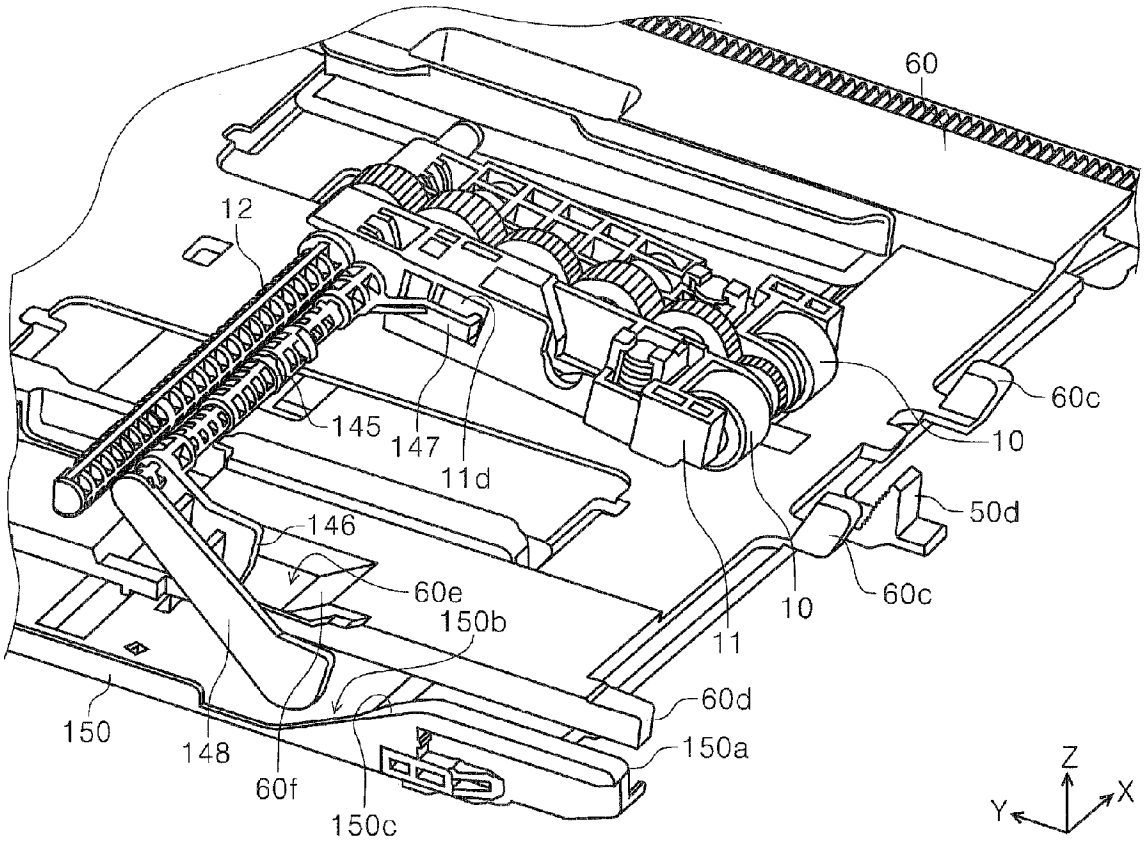
FIG. 25 is a perspective view illustrating the cam shaft, the bottom level side tray, and a top level side tray according to the second embodiment.

FIGS. 20 to 22 are perspective views illustrating a cam shaft 145 and a bottom level side tray 150 according to the second embodiment, and FIGS. 23 to 25 are perspective views illustrating the cam shaft 145, the bottom level side tray 150, and a top level side tray 60 according to the second embodiment.

Figure 26:
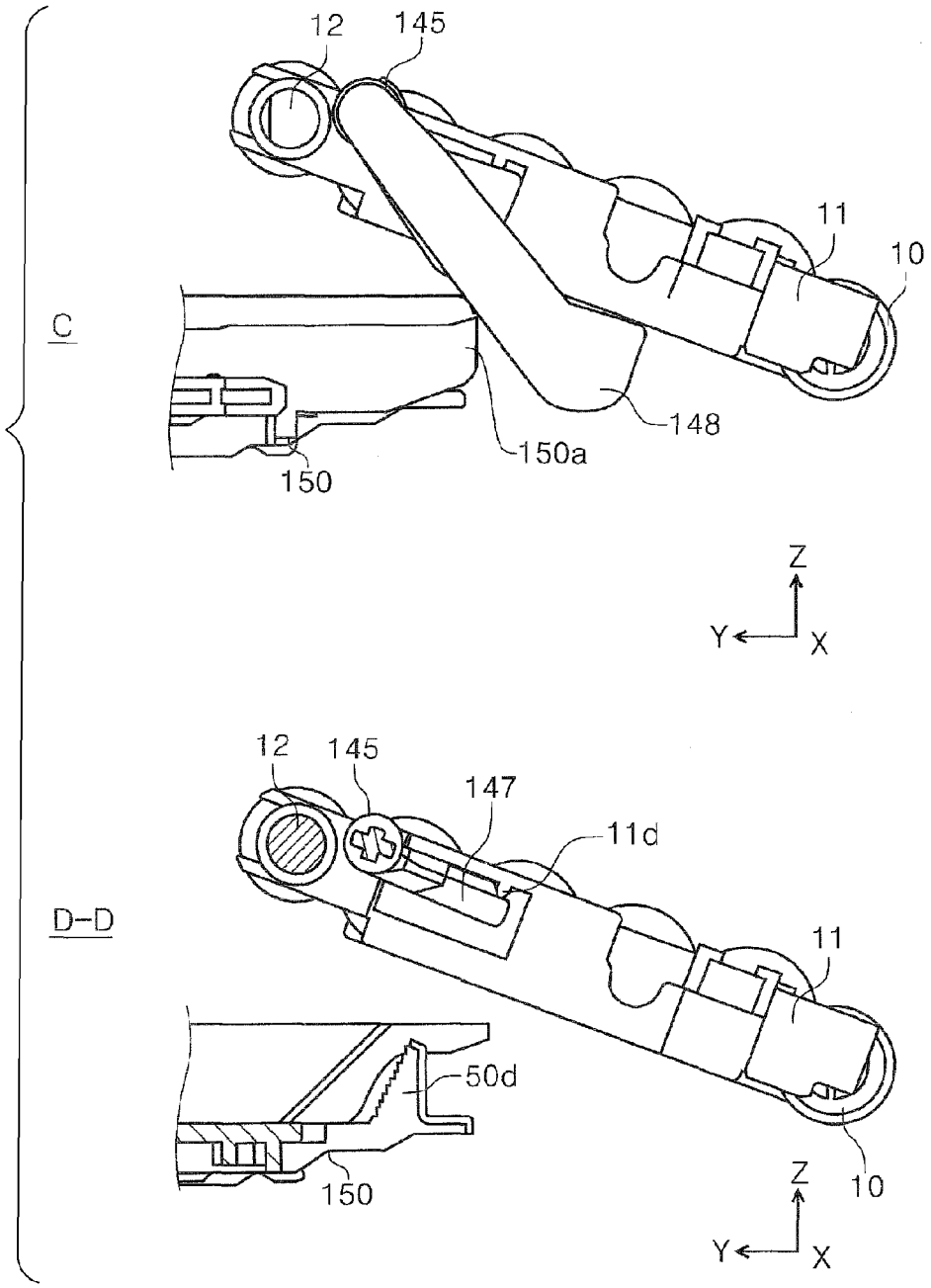
FIG. 26 is a diagram comparatively illustrating arrow C and cross section D-D of FIG. 20.
Figure 27:
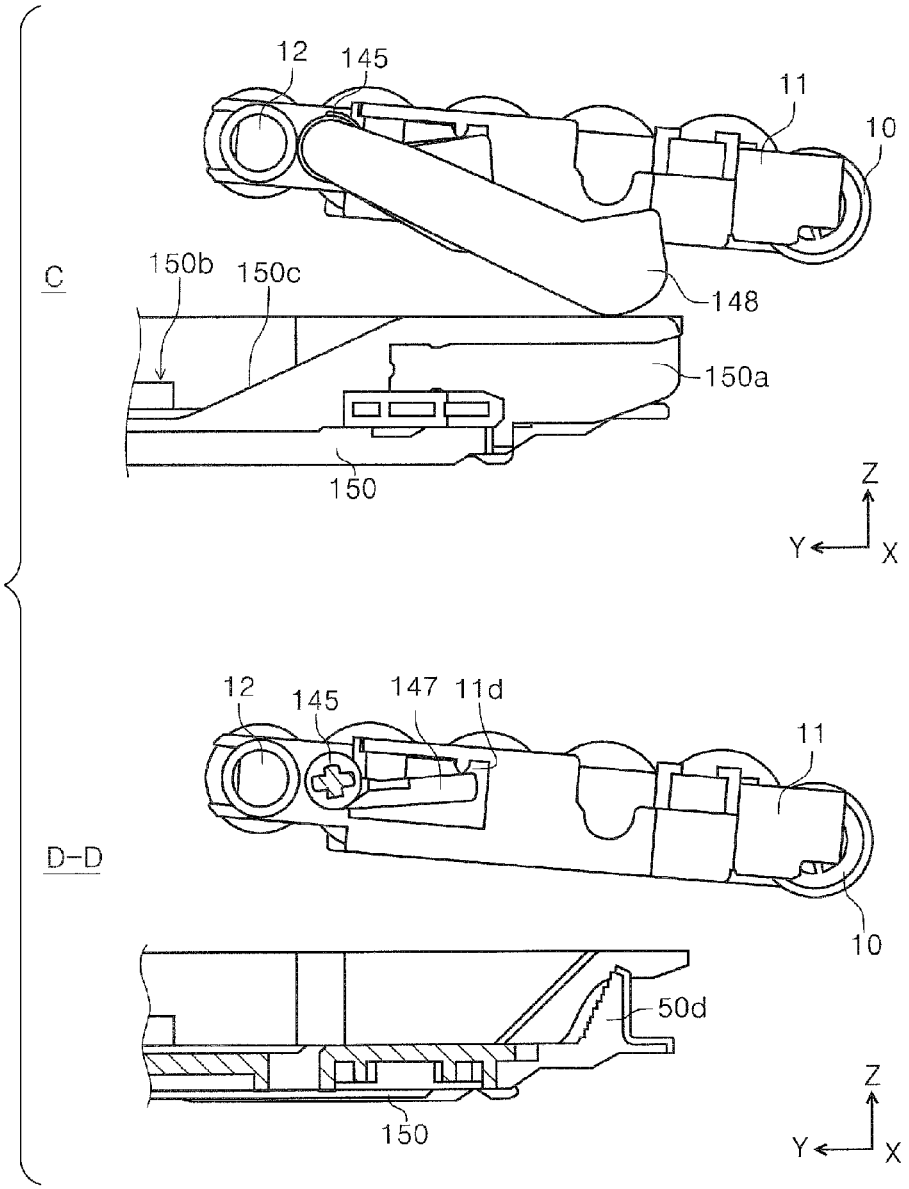
FIG. 27 is a diagram comparatively illustrating arrow C and cross section D-D of FIG. 20.
Figure 28:
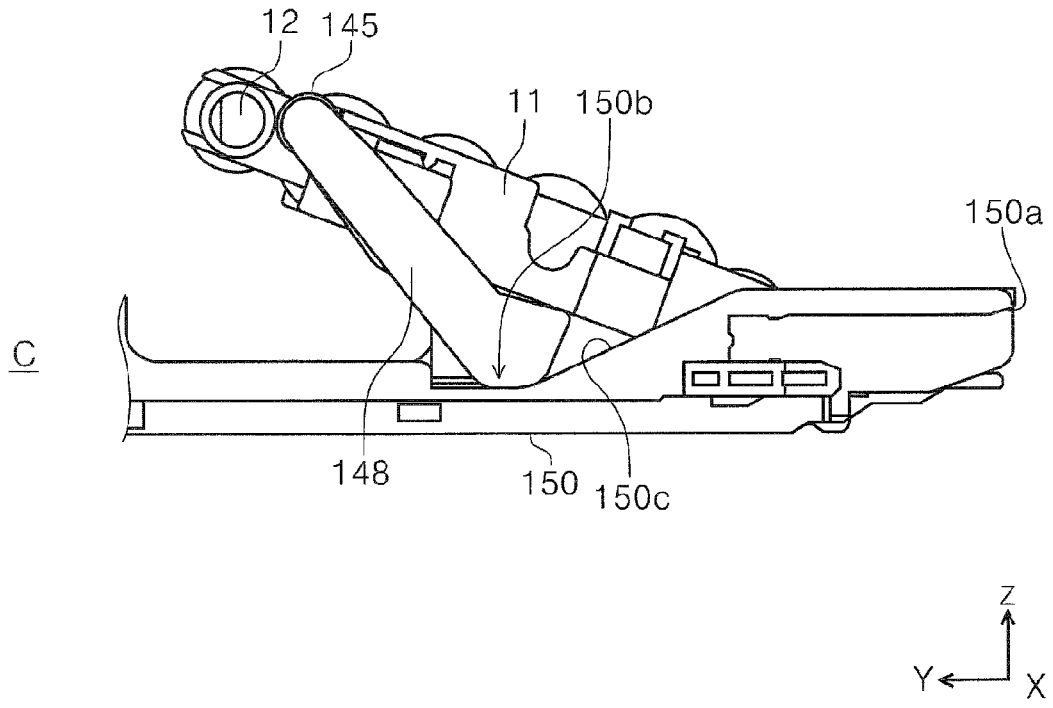
FIG. 28 is a view from arrow C of FIG. 20.
Figure 29:
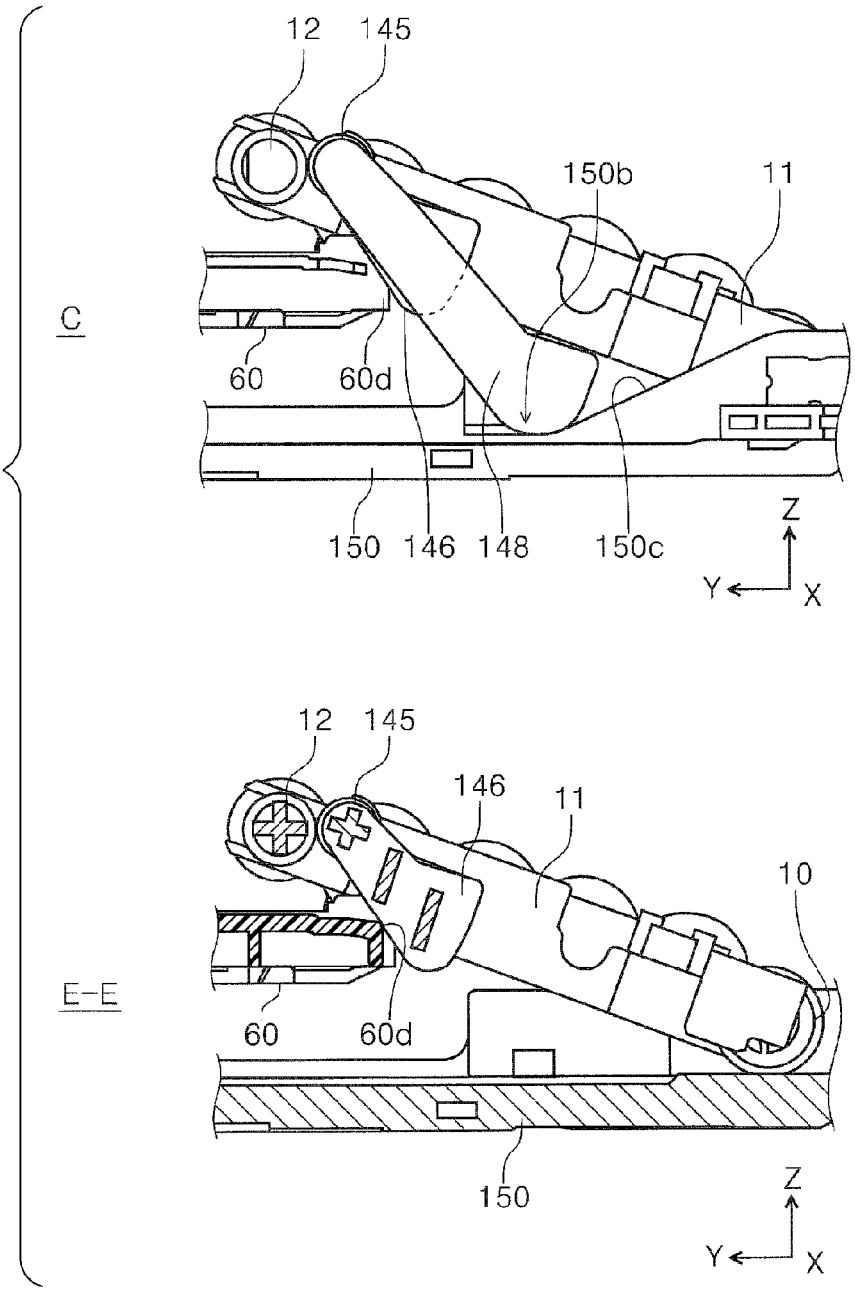
FIG. 29 is a diagram comparatively illustrating arrow C and cross section E-E of FIG. 20.
Figure 30:
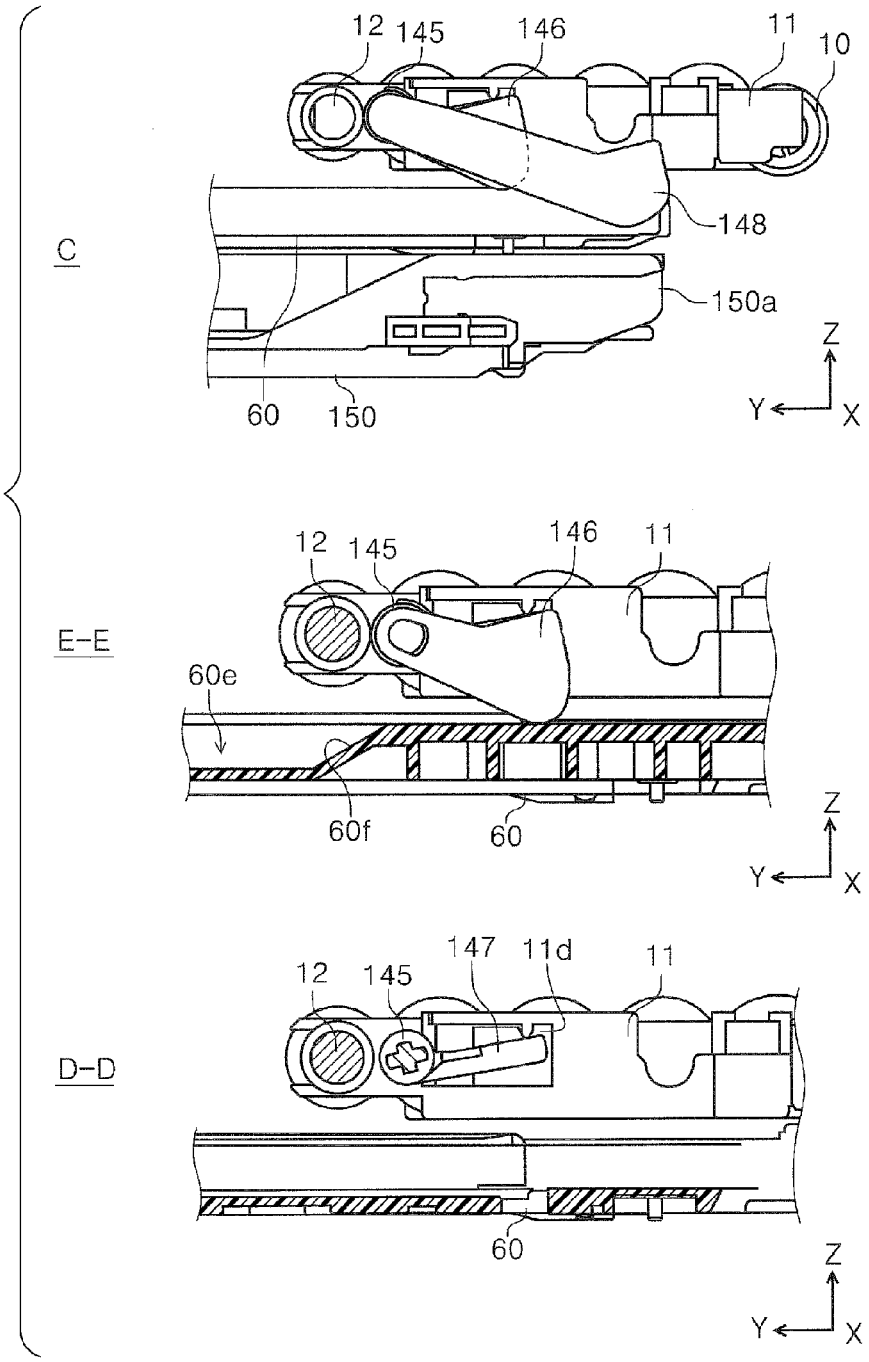
FIG. 30 is a diagram comparatively illustrating arrow C, cross section E-E and cross section D-D of FIG. 20.
Figure 31:
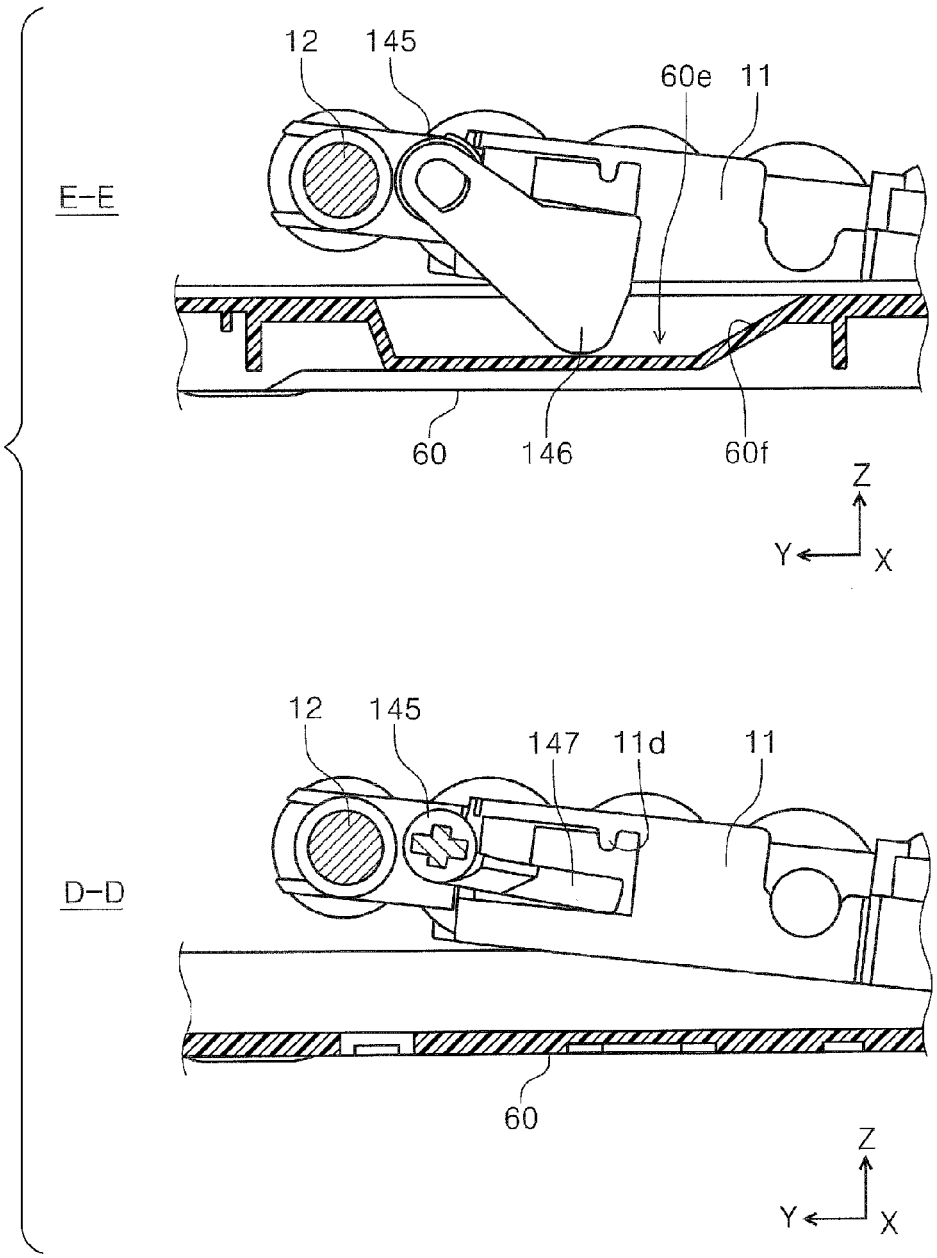
FIG. 31 is a diagram comparatively illustrating cross section E-E and cross section D-D of FIG. 20.

FIGS. 26 and 27 are diagrams comparatively illustrating arrow C and cross section D-D of FIG. 20, FIG. 28 is a view from arrow C of FIG. 20, FIG. 29 is a diagram comparatively illustrating arrow C and cross section E-E of FIG. 20, FIG. 30 is a diagram comparatively illustrating arrow C, cross section E-E and cross section D-D of FIG. 20, and FIG. 31 is a diagram comparatively illustrating cross section E-E and cross section D-D of FIG. 20.

Figure 32:
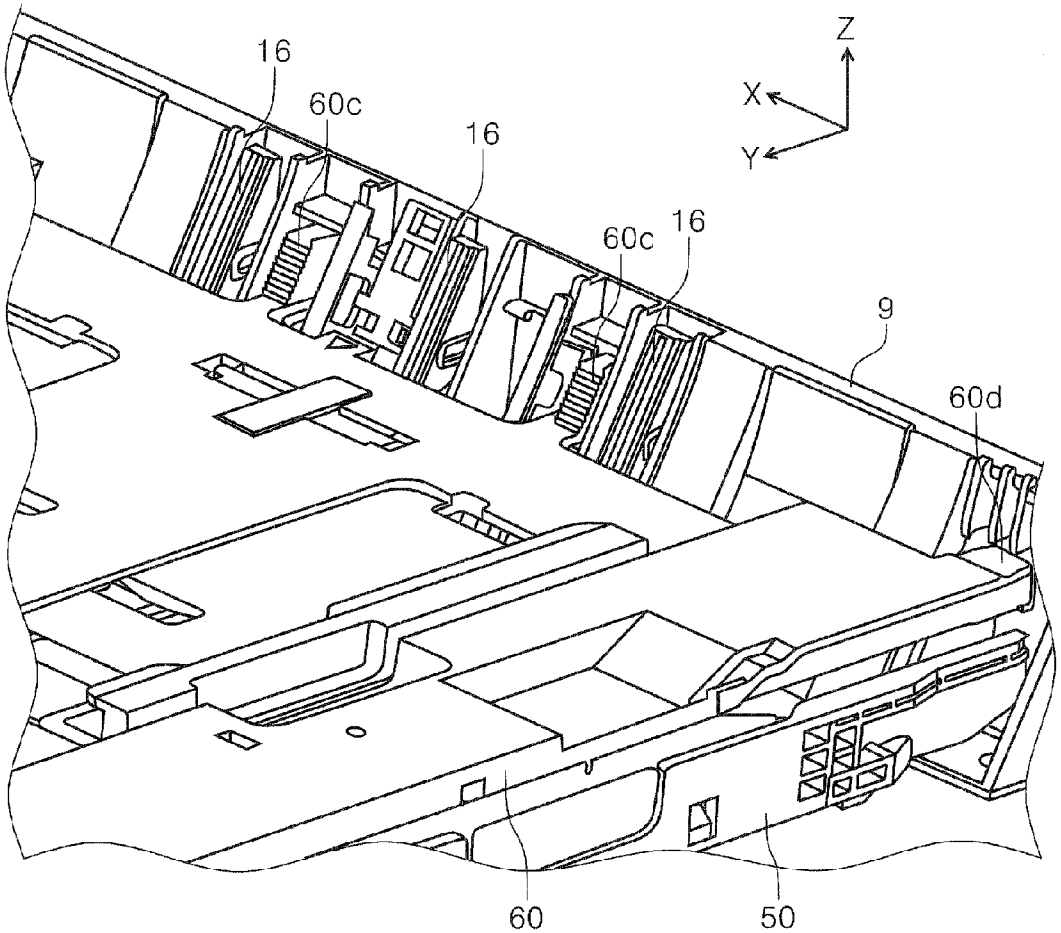
FIG. 32 is a perspective view of a leading end portion and a frame material of the top level side tray.
Figure 33:
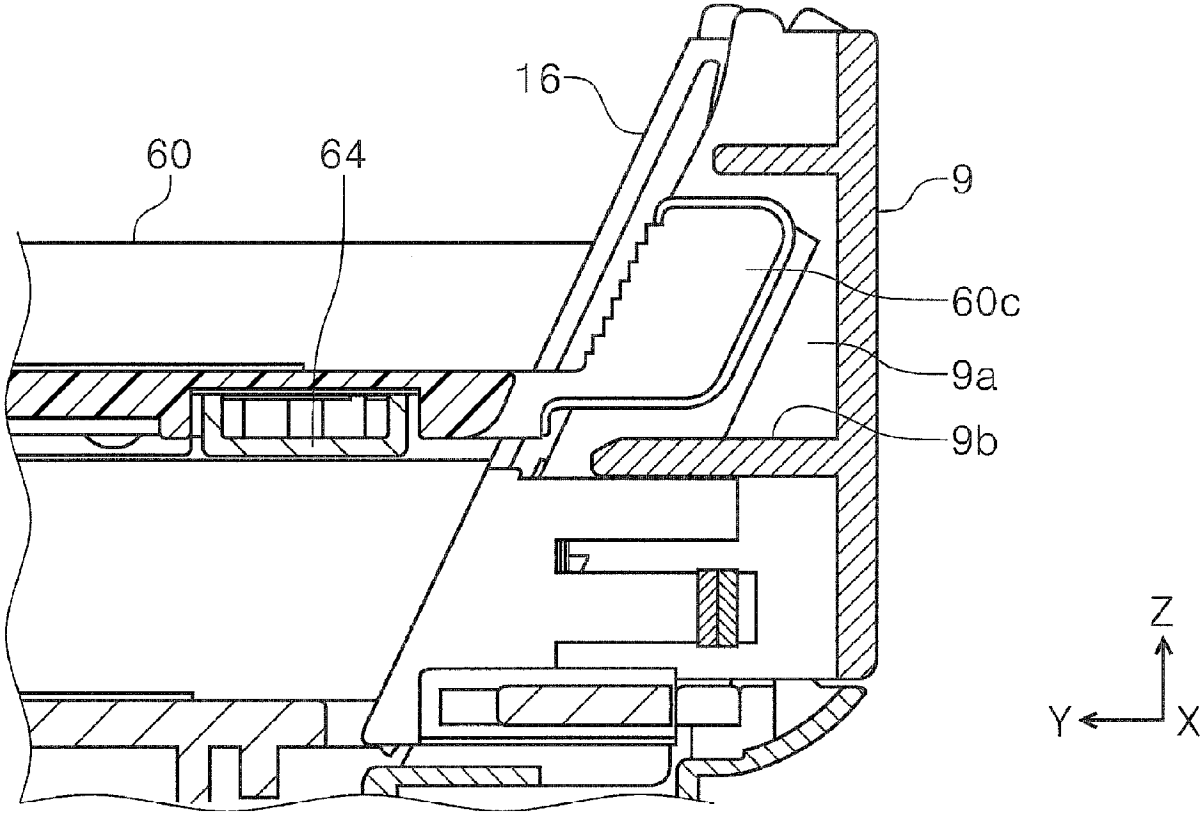
FIG. 33 is a sectional diagram of the leading end portion and the frame material of the top level side tray.

FIG. 32 is a perspective view of a leading end portion and a frame material 9 of the top level side tray 60, and FIG. 33 is a sectional diagram of the leading end portion and the frame material 9 of the top level side tray 60.

In the X-Y-Z coordinate system illustrated in the drawings, an X direction indicates an apparatus width direction and a paper width direction, a Y direction indicates an apparatus depth direction and a paper transport direction, and a Z direction indicates a vertical direction and an apparatus height direction. In the drawings, the +Y direction side is the apparatus front surface side, and the −Y direction side is the apparatus rear surface side.

1. Overall Configuration of Printer

Hereinafter, description will be given of the overall configuration of the printer 1 with reference to FIGS. 1 to 7. The printer 1 is provided with a scanner unit 3 on a top portion of an apparatus main body 2 (a recording unit) which performs ink jet recording on recording paper, which is an example of a recording medium, that is, the printer 1 is configured as a multifunction printer which is provided with a scanner function in addition to an ink jet recording function.

The scanner unit 3 is provided to be capable of rotating relative to the apparatus main body 2, and is capable of assuming a closed state (FIG. 1), and an open state (not illustrated) by rotating.

In the scanner unit 3, a cover 4 is a cover capable of opening and closing, and a document stand 3*a* (FIGS. 6 and 7) of the scanner unit 3 is made visible by opening the cover 4.

On the apparatus front surface, sign 5 is an operation panel which is formed by providing a power button, operation buttons which perform various print settings and recording execution, a display unit which performs preview display or the like of print setting content and a print image, and the like.

On the apparatus front surface, sign 59 is a cover capable of opening and closing which is provided on the bottom level side tray 50, and in FIG. 1, a state in which the cover 59 is closed is illustrated, and in FIG. 2, a state in which the cover 59 is open is illustrated. The cover 59 is configured such that, by opening the cover 59, the bottom level side tray 50, the top level side tray 60, and a output paper receiving tray 8 are exposed.

The output paper receiving tray 8 is provided to be capable of assuming a state of being stored in the apparatus main body 2 by a motor which is not illustrated, (FIGS. 1 and 2), and a state of protruding to the front side of the apparatus main body 2 (FIGS. 6 and 7), and by assuming the state of protruding to the front side of the apparatus main body 2, is capable of receiving the recording paper which is subjected to recording and is output.

The bottom level side tray 50 and the top level side tray 60 which is provided above the bottom level side tray 50 are capable of storing a plurality of sheets of recording paper, and each is independently attached to the apparatus main body 2 in a detachable manner. Even in a state in which one side is in the non-mounted state, as long as the other side is mounted, it is possible to feed the recording paper out from the mounted tray (described later in detail). In FIG. 3, sign 36 is a bottom portion guide rail which guides the bottom level side tray 50 in the attachment and detachment direction and supports the bottom level side tray 50, and sign 35 is a top portion guide rail which guides the top level side tray 60 in the attachment and detachment direction and supports the top level side tray 60. In FIG. 3, sign 49 indicates a tray storage portion which is provided in the apparatus main body 2 and stores the bottom level side tray 50 and the top level side tray 60.

In this manner, the bottom level side tray 50 and the top level side tray 60 are capable of being attached and detached independently in relation to the apparatus main body 2, and in a recording apparatus which is provided with a plurality of levels of trays in which it is not necessary to pull out a tray of another side when paper is set in a tray of one side, it is possible to improve the task efficiency during a paper setting task.

Although described in detail later, in a state of being mounted to the apparatus main body 2, the top level side tray 60 is provided so as to undergo sliding displacement between a withdrawn position (FIG. 6) and an abutting position (FIG. 7), and whichever position of the withdrawn position and the abutting position the top level side tray 60 is in, and, even if the top level side tray 60 is between the two positions, this is the "mounted state". In a case in which the top level side tray 60 is positioned further to the front side than the withdrawn position (further to the right side than the position of FIG. 6), the incomplete mounting state, that is, the "non-mounted state" of the top level side tray 60 is assumed.

A state in which the bottom level side tray 50 is completely pushed in to the abutting position (FIGS. 6 and 7) is the "mounted state", and other states are the "non-mounted state". Hereinafter, a "top and bottom tray non-mounted state" refers to a state in which both the bottom level side tray 50 and the top level side tray 60 are removed from the apparatus main body 2.

Next, on the top rear portion of the apparatus main body 2, sign 6 is a manual insert cover 6 capable of opening and closing, and by opening the manual insert cover 6, it is possible to perform manual insertion paper feeding of the recording paper which uses a manual insert tray 7 (FIGS. 6 and 7).

Next, description will be given of the paper transport path of the printer 1 with reference to FIGS. 6 and 7. The printer 1 according to the present embodiment is provided with the bottom level side tray 50 and the top level side tray 60 on the apparatus base portion, and the recording paper is fed one sheet at a time from the bottom level side tray 50 or the top level side tray 60.

The top level side tray 60 is provided to be capable of sliding (being displaced) between a feed-capable position (FIG. 7) and a withdrawn position (FIG. 6), and is configured to receive motive force of a motor (not illustrated) to be displaced between the feed-capable position (FIG. 7) and the withdrawn position (FIG. 6).

In FIGS. 6 and 7, the paper which is stored in the bottom level side tray 50 is indicated by sign P1, and the paper which is stored in the top level side tray 60 is indicated by sign P2 (hereinafter, in a case in which the two are not particularly distinguished, the paper will be referred to as "paper P").

The feed roller 10 (also referred to as a pickup roller) which is rotationally driven by a motor (not illustrated) is provided in a roller support member 11 (also referred to as a pickup arm or a rocking member) which rocks centered on a rotating shaft 12, and in a state in which the top level side tray 60 slides to the frontmost side of the apparatus (the right direction in FIGS. 6 and 7: the pulling out direction side of the top level side tray 60), that is, when the top level side tray 60 is in the withdrawn position (the state of FIG. 6), the topmost sheet of the paper P1 is fed from the bottom level side tray 50 through the feed roller 10 coming into contact with the topmost sheet of the paper P1 which is stored in the bottom level side tray 50.

When the top level side tray 60 is in the abutting position in which the top level side tray 60 is slid to the rearmost side of the apparatus (the left direction in FIGS. 6 and 7: the mounting direction side of the top level side tray 60, and the paper feed-out direction side), that is, in the feed-capable position of the top level side tray 60 (the state of FIG. 7), the topmost sheet of the paper P2 is fed out from the top level side tray 60 due to the feed roller 10 coming into contact with the topmost sheet of the paper P2 which is stored in the top level side tray 60 and rotating.

Even in a case in which either one of the bottom level side tray 50 and the top level side tray 60 is not mounted, it is possible to feed the paper from the other side, and thus, freedom is secured in the paper feeding, and an improvement in the ease of handling of the apparatus is obtained.

In the present embodiment, as illustrated in FIG. 8, the rotating shaft 12 forms a rocking shaft of the roller support member 11, and receives the motive force of a motor (not illustrated) to rotate, and thus, the rotating shaft 12 transmits the motive force from a transmission gear 13 to a transmission-target gear 15 via a gear train 14. The transmission gear 13 is provided in a position corresponding to the center in the width direction (the X direction) of the top level side tray 60 and the bottom level side tray 50, and the transmission-target gear 15 is provided integrally with the feed roller 10. In the present embodiment, the feed roller 10 is provided on both sides to interpose the transmission-target gear 15.

Next, returning to FIGS. 6 and 7, in the apparatus main body 2, a separation inclined surface 16 is provided in a position which faces the leading ends of the bottom level side tray 50 and the top level side tray 60, in a state in which the bottom level side tray 50 is mounted, a stopper 50*d* (refer to FIG. 4) which is provided on the leading end of the bottom level side tray 50 enters deeper than the separation inclined surface 16 (the left side in FIG. 6), and the leading end of the paper which is stored in the bottom level side tray 50 enters a state of being able to come into contact with the separation inclined surface 16.

In the top level side tray 60, in a state in which the top level side tray 60 is positioned at the feed-capable position (the abutting position: FIG. 7), a stopper 60*c* which is provided on the leading end of the top level side tray 60 enters deeper than the separation inclined surface 16, and the leading end of the paper which is stored in the top level side tray 60 enters a state of being able to come into contact with the separation inclined surface 16.

The state described above is also illustrated in FIG. 32. In FIG. 32, sign 9 is the frame material, and as illustrated in FIG. 33, receiving portions 9*a* and 9*a* which receive stoppers 60*c* and 60*c* are provided on the frame material 9. As illustrated in FIG. 33, in a state in which the top level side tray 60 is positioned at the feed-capable position, the top level side tray 60 (the stopper 60*c*) is not in contact with a base surface 9*b* of the receiving portion 9*a*, and a gap is formed between the top level side tray 60 and the base surface 9*b*.

This is due to the following reasons. In other words, in a case in which the top level side tray 60 (the stopper 60*c*) is in contact with the base surface 9*b* of the receiving portion 9*a*, friction arises therebetween, and depending on the friction state, the set state (for example, the up-down direction position) of the top level side tray 60 changes, and the paper feeding performance of the final sheet (the single last sheet) may be negatively influenced. Therefore, as described above, by configuring the top level side tray 60 (the stopper 60*c*) not to come into contact with the base surface 9*b* of the receiving portion 9*a*, it is possible to avoid the negative influence described above. In FIG. 33, sign 64 is a reinforcing frame which is shaped to extend in the paper width direction (the X direction). The reinforcing frame 64 is framed by bending a metal plate material so as to form a cross-sectional C-shape as illustrated, and suppresses vertical downward warping across the X direction of the top level side tray 60 which is formed of a resin material.

Next, returning to FIGS. 6 and 7, the paper P which is fed out from the bottom level side tray 50 or the top level side tray 60 is separated into the topmost sheet of the paper P to be fed and the next sheet onward of the paper P due to the leading end of the paper P proceeding downstream while abutting the separation inclined surface 16.

An intermediate roller 17 which is rotationally driven by a motor (not illustrated) is provided ahead of the separation inclined surface 16 on the downstream side in the transport path, the paper P is curved and inverted by the intermediate roller 17 and heads toward the front side of the apparatus. Signs 19, 20, and 21 are follower rollers, the paper P is nipped by at least the follower roller 19 and the intermediate roller 17, or by the follower roller 20 and the intermediate roller 17, and is fed to the downstream side.

A transport drive roller 24 which is rotationally driven by a motor (not illustrated), and a transport follower roller 25 which is in contact with the transport drive roller 24 to follow the rotation thereof are provided beyond the intermediate roller 17, and the paper P is fed under a recording head 30 by the rollers 24 and 25.

Next, the recording head 30 which ejects an ink is provided on a base portion of a carriage 29, and the carriage 29 is driven to move reciprocally in a main scanning direction (the obverse-reverse direction of the paper surface in FIGS. 6 and 7) by a motor (not illustrated).

A support member 28 which supports the paper P is provided in a position facing the recording head 30, and the interval between the paper P and the recording head 30 is defined by the support member 28. An output drive roller 31 which is rotationally driven by a motor (not illustrated), and an output follower roller 32 which is in contact with the output drive roller 31 to follow the rotation thereof are provided on the downstream side of the support member 28. The paper which is subjected to recording by the recording head 30 is output toward the output paper receiving tray 8 described above by the rollers 31 and 32.

In a case in which both surfaces of the paper P are subjected to recording, after the obverse surface of the paper P is subjected to recording by the recording head 30, by causing the paper P to switch back, the paper P is caused to enter the feed path from the bottom side of the intermediate roller 17 and to be curved and inverted, and thus, it is possible to subject the reverse surface of the paper P to recording.

2. Outline of Paper Feed Unit

Hereinabove, description is given of the overall configuration of the printer 1, and hereinafter, detailed description will be given of a paper feed unit which is provided with the feed roller 10.

A base surface 50*a* of the bottom level side tray 50 is provided with an edge guide 52 (FIGS. 6 and 7) capable of sliding in the paper feed-out direction, and the position of the rear end edge is restricted by the edge guide 52. In the present specification, the paper feed-out direction from the bottom level side tray 50 or the top level side tray 60 is the left direction in FIGS. 6 and 7, that is, a direction heading toward the separation inclined surface 16, and the paper length direction and the slide direction of the top level side tray 60 is the left-right direction (the Y direction) in FIGS. 6 and 7. The paper width direction is a direction which is parallel to the obverse-reverse direction (the X direction) of the paper surface in FIGS. 6 and 7, that is, which is parallel to the paper surface, and is perpendicular to the paper feed-out direction.

Edge guides 51A and 51B capable of sliding in the paper width direction are also provided on the bottom level side tray 50 (FIG. 4), and the positions of the side edges of the paper are restricted by the edge guides 51A and 51B. In the present embodiment, the two edge guides 51A and 51B which restrict the side edges of the paper are configured to be capable of being displaced simultaneously so as to be positioned symmetrically centered on the center position in the paper width direction. In other words, the printer 1 according to the present embodiment treats the center position in the paper width direction as a feed reference position (the same applies to the top level side tray 60).

A high friction material 53 is disposed in the vicinity of a location corresponding to a position of contact between the feed roller 10 and the paper P1 on the base surface 50*a* of the bottom level side tray 50, and the stack of paper is held by the high friction material 53 so that the whole paper stack is not fed to the downstream side during the paper feeding by the feed roller 10.

The stopper 50*d* which restricts the position of the leading end of the paper is provided on the paper leading end side (the left side in FIG. 4) in the bottom level side tray 50, and due to the stopper 50*d*, the bottom level side tray 50 is configured such that the paper does not leave the confines of the bottom level side tray 50 when the paper is set in the bottom level side tray 50. In a case in which the bottom level side tray 50 is mounted to the apparatus main body 2 as described above, the stopper 50*d* enters deeper into the apparatus than the separation inclined surface 16 and does not come into contact with the paper which is fed. In other words, the stopper 50*d* does not impede the feeding of the paper during the paper feeding.

Meanwhile, in the same manner as with the bottom level side tray 50, as illustrated in FIG. 5, a base surface 60*a* of the top level side tray 60 is provided with an edge guide 62 capable of sliding in the paper length direction, edge guides 61A and 61B capable of sliding in the paper width direction, and the stoppers 60*c* and 60*c*. A high friction material 63 is disposed in the vicinity of a location corresponding to the position of contact between the feed roller 10 and the paper P2.

The top level side tray 60 is provided to be capable of sliding in the paper feed-out direction as described above in a state of being mounted to the apparatus main body 2.

A rack portion 60*b* is formed along the sliding direction of the top level side tray 60 on the top surface of the end portion of one side of the top level side tray 60, a rack and pinion mechanism is configured by a pinion gear (not illustrated) meshing with the rack portion 60*b*, and the top level side tray 60 is subjected to sliding displacement between the feed-capable position (the abutting position: FIG. 7) and the withdrawn position (FIG. 6) due to the pinion gear rotating through the drive force of a motor (not illustrated).

3. Intermediate Position Holding of Roller Support Member

Next, description will be given of intermediate position holding of the roller support member 11. The printer 1 is provided with the holding unit 39 which holds the roller support member 11 in an intermediate position (described later, FIGS. 8 and 9). In a state in which both the bottom level side tray 50 and the top level side tray 60 are removed from the apparatus main body 2 (hereinafter, referred to as a "top and bottom tray non-mounted state"), the feed roller 10 is held by the holding unit 39. The position (hereinafter referred to as the "intermediate position") at which the feed roller 10 is held is lower than the height position of the feed roller 10 when the feed roller 10 is in contact with the base surface 60*a* onto which the paper P2 is placed in the top level side tray 60, and is higher than the height position of the feed roller 10 when the feed roller 10 is in contact with the topmost sheet of the paper P1 in a state in which the maximum number of sheets of the paper P1 is stored in the bottom level side tray 50.

The holding unit 39 is provided with a slider 43, a rotating shaft 40, a first lever 41, and a second lever 42. The slider 43 is provided to be capable of sliding in the mounting direction of the bottom level side tray 50 and in the opposite direction, and is provided to be capable of engaging with the bottom level side tray 50, the rotating shaft 40 is capable of rotating, the first lever 41 is provided on the one end side of the rotating shaft 40 and engages with the roller support member 11, and the second lever 42 is provided on the other end side of the rotating shaft 40 and is capable of engaging with the slider 43. The holding unit 39 is provided with a coil spring 44 as a shaft biasing unit which biases the rotating shaft 40 in a direction in which the first lever 41 pushes the roller support member 11 upward.

The slider 43, the rotating shaft 40, and the rotating shaft 12 are provided on a frame (not illustrated).

The coil spring 44 exerts a biasing force between the frame and the second lever 42 biases the roller support member 11 (a lever engaging portion 11*c* of the roller support member 11: FIG. 10) via the second lever 42, the rotating shaft 40, and the first lever 41 in a direction in which the roller support member 11 is pushed upward. Therefore, in a case in which the slider 43 is in a state of not engaging with the bottom level side tray 50 (a pressing portion 50*e*), that is, when the bottom level side tray 50 is in the non-mounted state, the feed roller 10 is held in the intermediate position. At this time, the position (the intermediate position) of the feed roller 10 is a position slightly lower than the position of the feed roller 10 in the F-F-1 sectional diagram of FIG. 10.

In this state, the second lever 42 pushes a second engaging portion 43*b* of the slider 43 in a tray pull-out direction, and thus, the slider 43 is positioned in the tray pull-out direction in the sliding range.

When the bottom level side tray 50 is mounted from the top and bottom tray non-mounted state, a first engaging portion 43*a* of the slider 43 is engaged with the pressing portion 50*e* of the leading end of the bottom level side tray 50, and the slider 43 is pushed in the tray mounting direction. Accordingly, the second engaging portion 43*b* of the slider 43 causes the rotating shaft 40 to rotate via the second lever 42 against the biasing force of the coil spring 44, the leading end of the first lever 41 drops, and the roller support member 11 becomes capable of rocking downward. In other words, the holding of the feed roller 10 in the intermediate position is released, the feed roller 10 drops under its own weight, and it is possible to come into contact with the paper P1 which is stored in the bottom level side tray 50 (the cross section F-F-2 of FIG. 10).

In the intermediate position, the roller support member 11 is in a position which interferes with the top level side tray 60; however, when the top level side tray 60 is mounted, the roller support member 11 is pushed upward by a cam mechanism (described later), and the top level side tray 60 does not collide with the roller support member 11.

In the mounted state of the top level side tray 60, as illustrated in the cross section F-F-1 of FIG. 10, the lever engaging portion 11*c* of the roller support member 11 and the first lever 41 assume a separated state, and the first lever 41 does not impede the rocking operation of the roller support member 11 during the paper feeding from the top level side tray 60.

4. Posture Switching of Roller Support Member by Top Level Side Tray

Next, description will be given of the posture switching of the roller support member 11 by the top level side tray 60.

As illustrated in FIGS. 8, 9, and 11 onward, the cam shaft 45 is provided in the tray storage portion 49 (FIGS. 3, 6, and 7) which stores the top and bottom trays. The cam shaft 45 extends in the same direction as the extending direction (the X direction) of the rotating shaft 12, a cam follower portion 46 which forms a "first engaging portion" is provided on one end side of the cam shaft 45, and a cam portion 47 which forms a "second engaging portion" is provided on the other end side of the cam shaft 45.

In the same manner as the rotating shaft 40, the rotating shaft 12, and the like described above, the cam shaft 45 is provided on a frame (not illustrated).

The cam follower portion 46 which is provided on the cam shaft 45 is provided in a position to be capable of engaging with a leading end portion 60*d* of the top level side tray 60. The leading end portion 60*d* of the top level side tray 60 is the leading end portion of one side among both sides (both sides in the X direction, or both side end portions) of the top level side tray 60.

The cam portion 47 which is provided on the cam shaft 45 is in a position capable of engaging with a lever engaging portion 11*d* which is formed on the inside of a hold which is formed in the side surface of the roller support member 11. In other words, the cam portion 47 is inserted into the hole which forms the lever engaging portion 11*d*.

Figure 15:
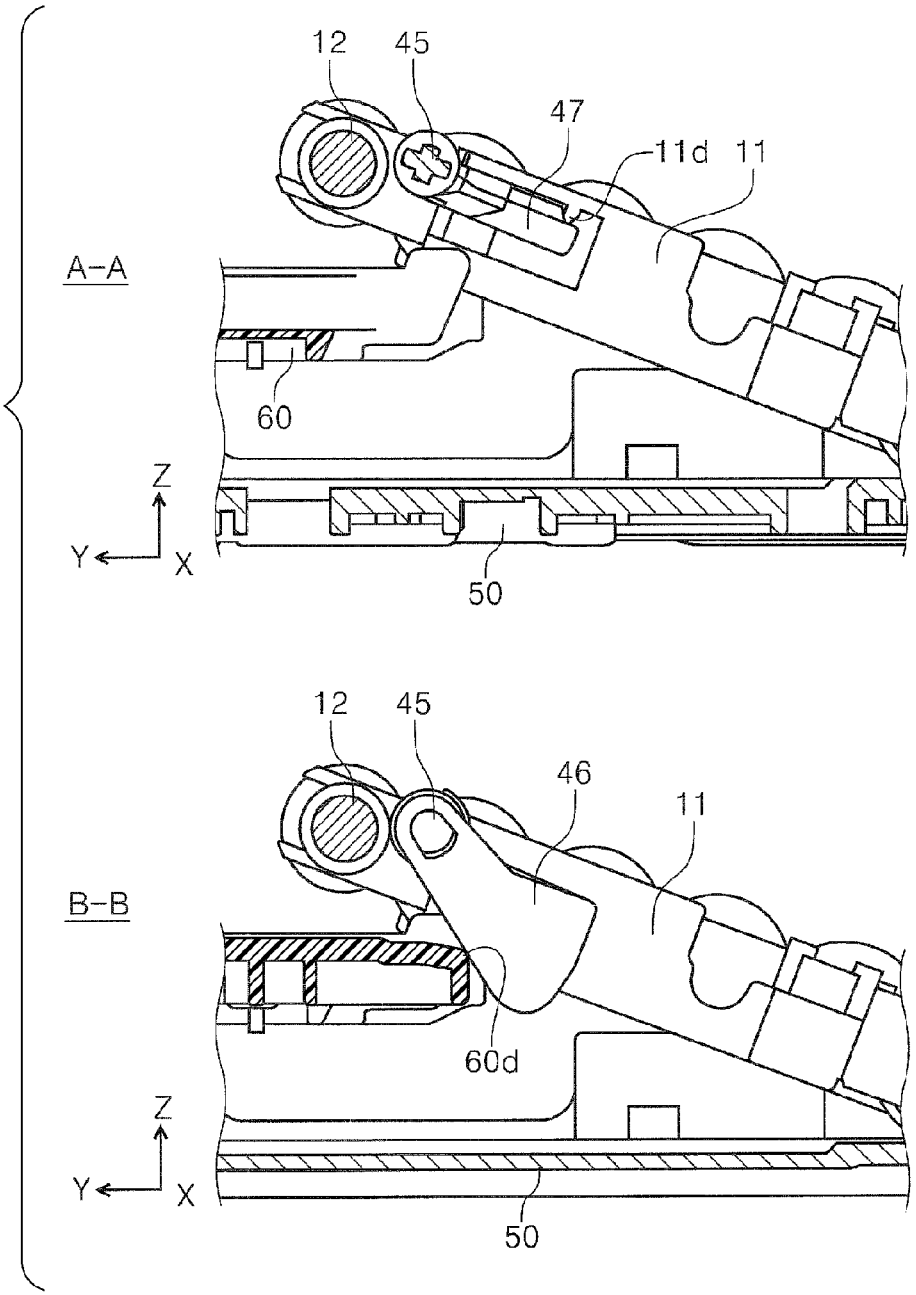
FIG. 15 is a diagram comparatively illustrating cross section A-A and cross section B-B of FIG. 11.

FIG. 11 and FIG. 15 which corresponds to FIG. 11 illustrate a state in which the bottom level side tray 50 is mounted and the top level side tray 60 is in the withdrawn position. In this state, as illustrated in FIG. 15, although the cam follower portion 46 is in a state in which contact with the leading end portion 60*d* of the top level side tray 60 is started, the cam portion 47 is not pushing the roller support member 11 (the lever engaging portion 11*d*) upward, and the roller support member 11 is in a posture which interferes with the top level side tray 60.

Figure 12:
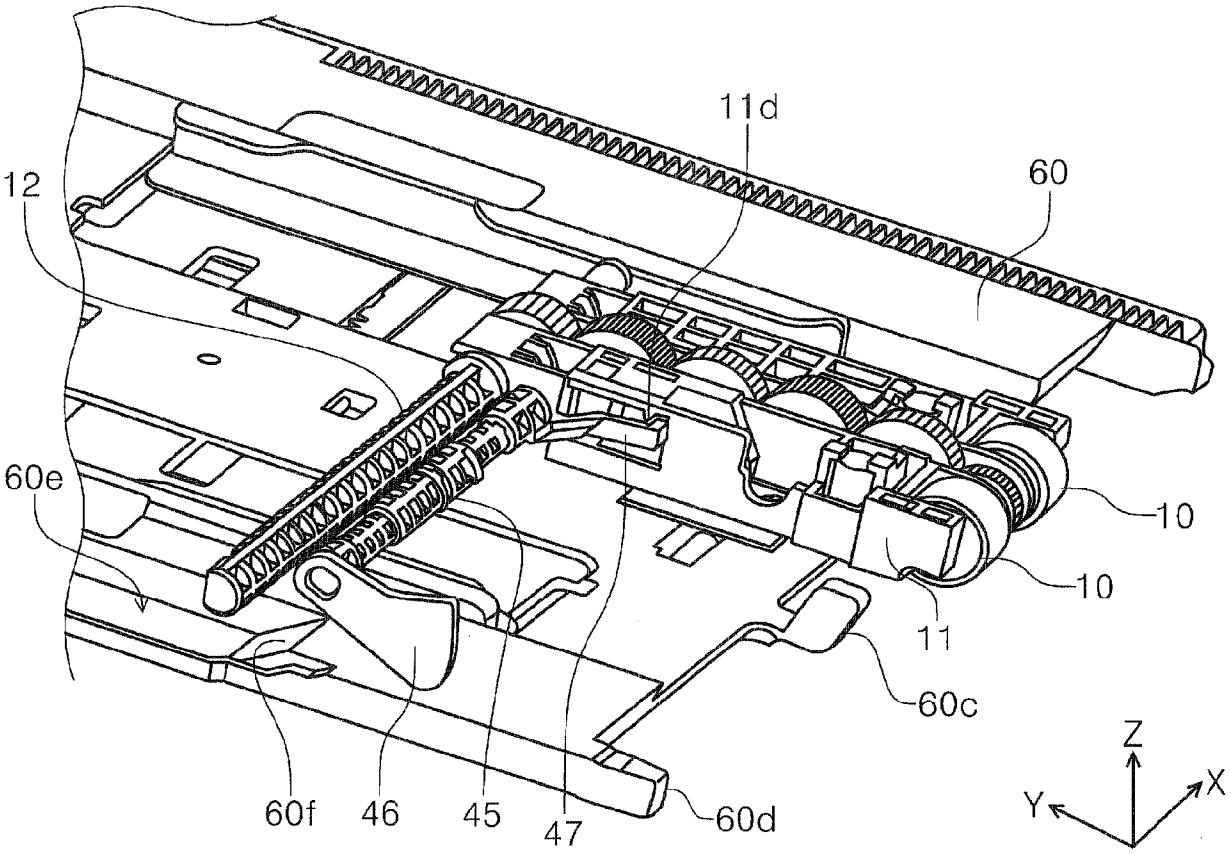
FIG. 12 is a perspective view illustrating the relationship between the cam shaft and the top level side tray.
Figure 16:
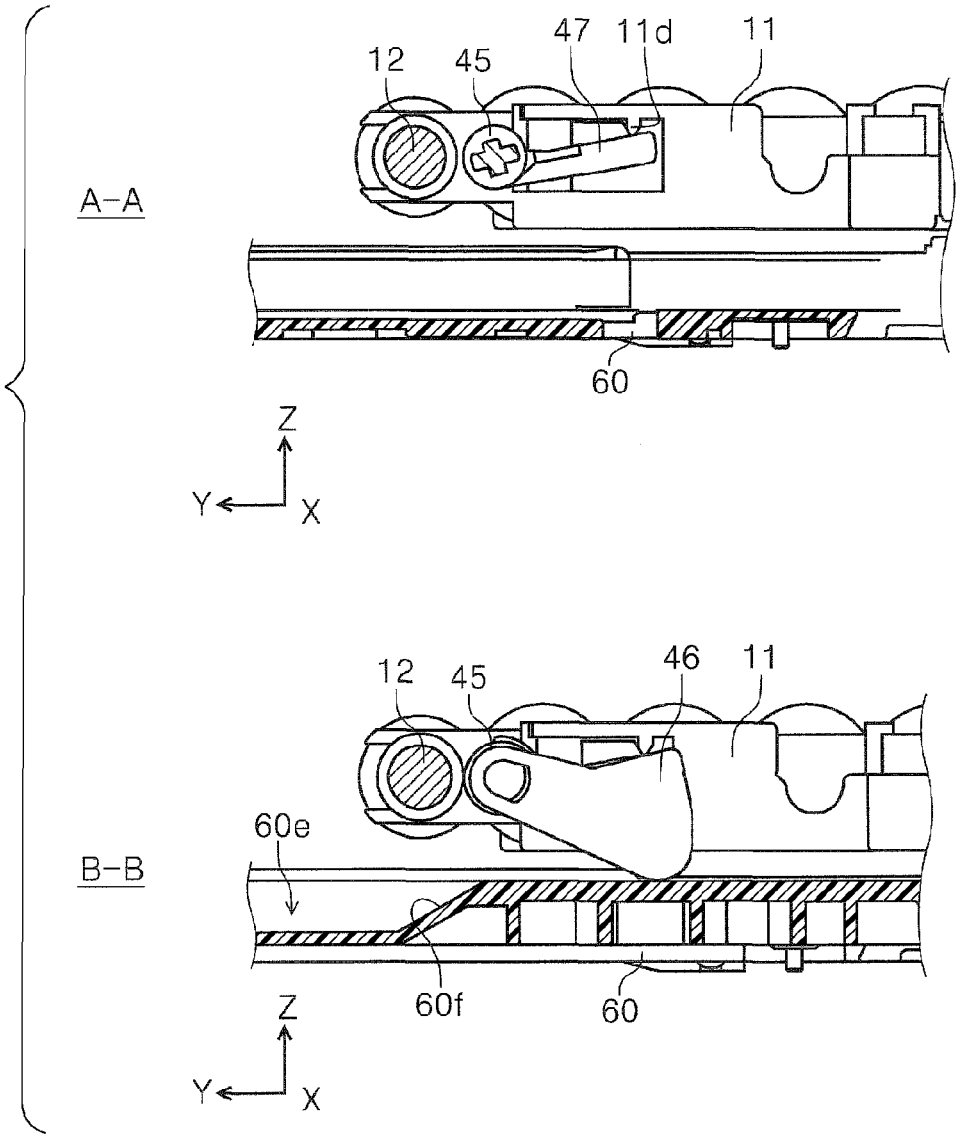
FIG. 16 is a diagram comparatively illustrating cross section A-A and cross section B-B of FIG. 11.

When the top level side tray 60 moves from this state toward the feed-capable position (toward the right direction in FIG. 15), as illustrated in FIG. 12 and FIG. 16 which is a sectional diagram corresponding to FIG. 12, the cam follower portion 46 is pushed up onto the leading end portion 60*d* of the top level side tray 60 and assumes a state of being in contact with the top surface of the top level side tray 60. In this process, the cam shaft 45 rotates, the cam portion 47 pushes the roller support member 11 (the lever engaging portion 11*d*) upward, and the roller support member 11 withdraws upward from a proceeding-withdrawing region of the top level side tray 60.

In this state, the roller support member 11 is apt to drop downward under its own weight; however, the actions of the cam portion 47, the cam shaft 45, and the cam follower portion 46 cause a posture in which the roller support member 11 is rocked upward to be maintained. In this posture, the feed roller 10 which is supported by the roller support member 11 is in a position in which the feed roller 10 does not come into contact with the paper P2 which is stored in the top level side tray 60 (a position in which there is no contact even if the maximum number of sheets are present).

Figure 13:
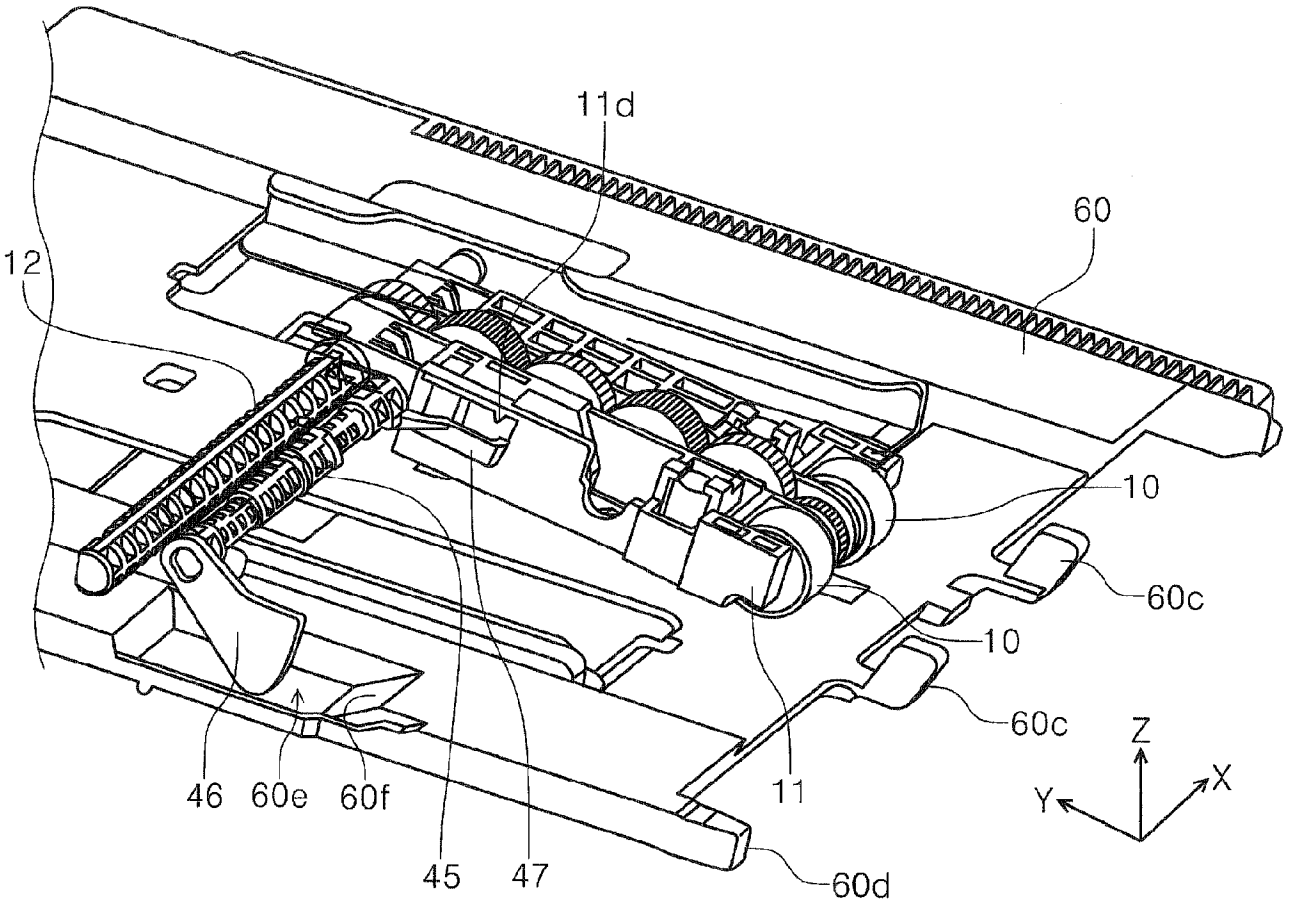
FIG. 13 is a perspective view illustrating the relationship between the cam shaft and the top level side tray.

Here, as illustrated in FIG. 13, a recessed portion 60*e* and an inclined surface 60*f* are formed in the top level side tray 60. When the top level side tray 60 moves further from the position illustrated in FIGS. 12 and 16 toward the feed-capable position, as illustrated in FIG. 13 and FIG. 17 which is a sectional diagram corresponding to FIG. 13, the cam follower portion 46 is guided from the top surface of the top level side tray 60 to the inclined surface 60*f* and enters the recessed portion 60*e*. Due to the cam follower portion 46 entering the recessed portion 60*e*, the supporting of the roller support member 11 by the cam portion 47 is released, and it becomes possible for the roller support member 11 to rock downward. In other words, the feed roller 10 which is supported by the roller support member 11 becomes capable of coming into contact with the paper P2 which is stored in the top level side tray 60, and it becomes possible to feed paper out from the top level side tray 60.

Figure 14:
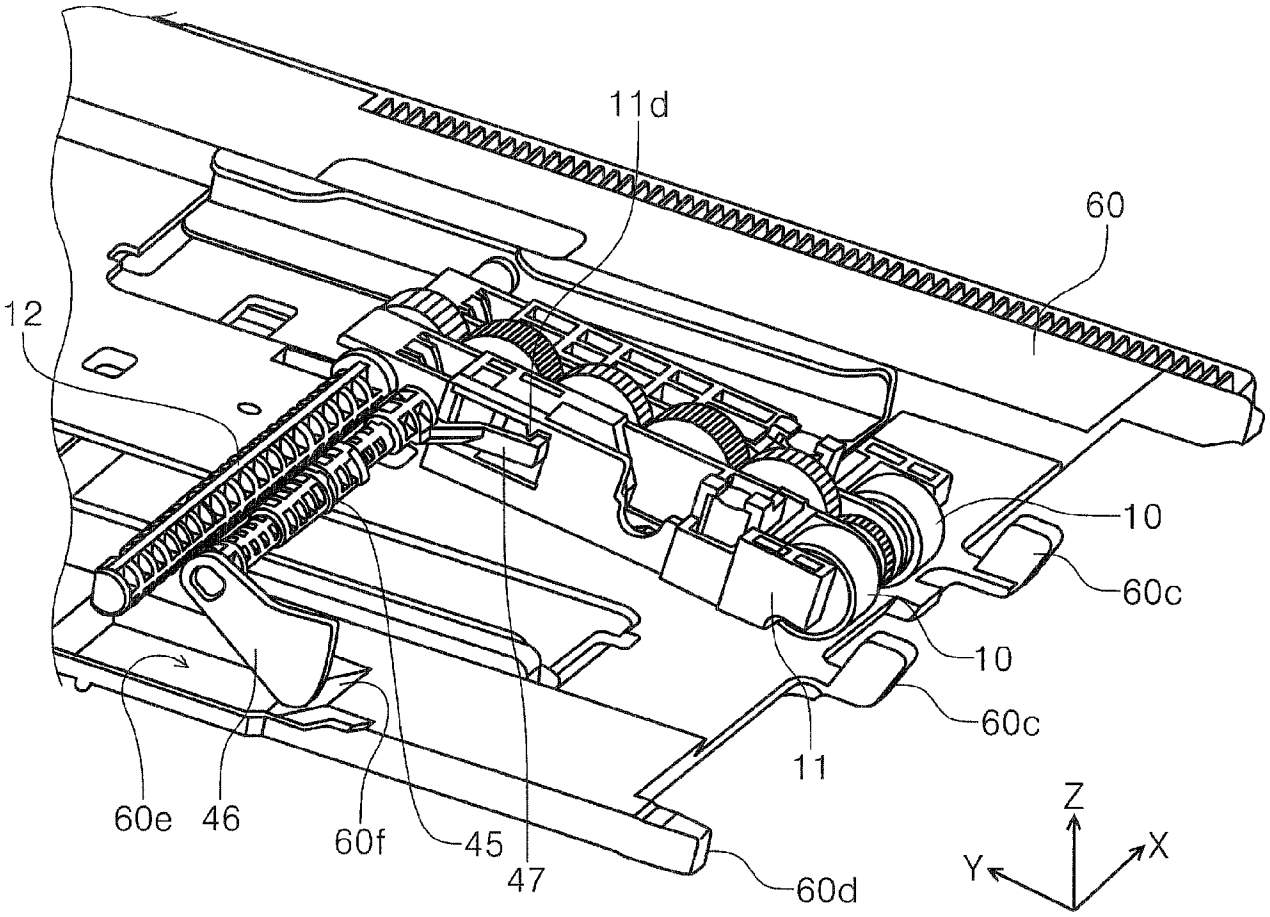
FIG. 14 is a perspective view illustrating the relationship between the cam shaft and the top level side tray.

Next, in the process in which the top level side tray 60 moves from the feed-capable position (FIGS. 13 and 17) to the withdrawn position, as illustrated in FIG. 14 and FIG. 18 which is a sectional diagram corresponding to FIG. 14, the cam follower portion 46 is guided onto the top surface of the top level side tray 60 by the inclined surface 60*f*. Accordingly, the roller support member 11 is pushed upward again, and the feed roller 10 separates from the paper P2 which is stored in the top level side tray 60.

Here, description will be given of the positional relationship between the cam follower portion 46 and the cam portion 47 which are formed on the cam shaft 45, with reference to FIG. 19. FIG. 19 illustrates the posture of the cam follower portion 46 and the cam portion 47 in the state illustrated in FIGS. 11 and 15.

In the present embodiment, when the top level side tray 60 pushes the roller support member 11 upward via the cam follower portion 46, the cam shaft 45 and the cam portion 47, a height direction displacement amount Y2 of an engagement position T2 between the roller support member 11 and the cam portion 47 (the second engaging portion) per predetermined rotational angle $\alpha$ of the cam shaft 45 is set to be greater than a height direction displacement amount Y1 of an engagement position T1 between the top level side tray 60 and the cam follower portion 46 (the first engaging portion).

The setting described above may be changed by adjusting the phase between the cam follower portion 46 and the cam portion 47 in the cam shaft 45 in FIG. 19. As described above, by setting the height direction displacement amount Y2 of the engagement position T2 between the roller support member 11 and the cam portion 47 (the second engaging portion) per the predetermined rotational angle $\alpha$ of the cam shaft 45 to be greater than the height direction displacement amount Y1 of the engagement position T1 between the top level side tray 60 and the cam follower portion 46 (the first engaging portion), it is possible to increase the vertical direction displacement amount of the roller support member 11 in relation to the horizontal direction displacement amount of the top level side tray 60.

As a result, it is possible to swiftly push the roller support member 11 upward, that is, it is possible to swiftly cause the feed roller 10 to withdraw upward. Accordingly, it is possible to suppress the displacement of the top level side tray 60 while maintaining the state in which the feed roller 10 is in contact with the paper which is stored in the top level side tray 60.

As a result, it is possible to avoid or suppress a problem in which, when the top level side tray 60 is displaced, the feed roller 10 pulls the paper which is stored in the top level side tray 60 out from within the tray.

As another embodiment, a distance L1 from the engagement position T1 (the engagement position between the top level side tray 60 and the cam follower portion 46) in FIG. 19 to a rotational center C1 of the cam shaft 45 is set to be longer than a distance L2 from the engagement position T2 (the engagement position between the roller support member 11 and the cam portion 47) to the rotational center C1 of the cam shaft 45, and thus, it is possible to obtain the following effects.

In other words, in FIG. 19, since the engagement position T1 is a force application point, the cam shaft 45 is a fulcrum, and the engagement position T2 is a point of action, due to the distance L1 being longer than the distance L2, it is possible to push the roller support member 11 upward with a smaller operational force using the principle of leverage.

A summary of the configuration of the invention described is given hereinafter. In other words, the printer 1 according to the present embodiment is provided with the recording head 30, the top level side tray 60, the tray storage portion 49, the feed roller 10, and the roller support member 11. The recording head 30 forms a recording unit which performs recording on paper, which is an example of a recording medium, the top level side tray 60 stores the paper, the tray storage portion 49 stores the top level side tray 60, the feed roller 10 feeds the paper out from the top level side tray 60, and the roller support member 11 supports the feed roller 10 and causes the feed roller 10 to proceed or withdraw in relation to the top level side tray 60 through a change in posture. The cam shaft 45 which is capable of rotating is provided in the tray storage portion 49, and the cam shaft 45 is provided with the cam follower portion 46 and the cam portion 47. The cam follower portion 46 serves as the first engaging portion which engages with the top level side tray 60, the cam portion 47 serves as the second engaging portion which engages with the roller support member 11, and the roller support member 11 is configured to change posture due to the top level side tray 60 causing the cam shaft 45 to rotate.

According to the configuration described above, as described with reference to FIG. 19, by adjusting the engagement between the cam follower portion 46 and the top level side tray 60 and the engagement between the cam portion 47 and the roller support member 11, it is possible to easily adjust the operational force when changing the posture of the roller support member 11 using the top level side tray 60.

In the present embodiment, the roller support member 11 is configured to be provided to be capable of rocking centered on the rotating shaft 12 (the rocking shaft) and to cause the feed roller 10 to proceed or withdraw in relation to the top level side tray 60 by rocking, and the cam shaft 45 is a separate member from the rotating shaft 12. Therefore, it is possible to secure a greater degree of freedom in the setting of the engagement position T1 between the cam follower portion 46 and the top level side tray 60, and the engagement position T2 between the cam portion 47 and the roller support member 11, and by extension, it is possible to provide a recording apparatus which further takes usability into account.

In the present embodiment, in the insertion-removal direction of the top level side tray 60 (the Y direction), the cam shaft 45 is positioned on the insertion direction side (the tray leading end side) of the top level side tray 60 in relation to the rotating shaft 12. Therefore, it is possible to separate the engagement position T2 (FIG. 19) between the roller support member 11 and the cam portion 47 from the rotating shaft 12 in the tray insertion direction (the right direction in FIG. 19), and by extension, it is possible to push the roller support member 11 upward with a smaller operational force. In other words, since the roller support member 11 is provided to be capable of rocking centered on the rotating shaft 12, it is possible to push the roller support member 11 upward with a smaller force by pushing the roller support member 11 upward at a further position from the rotating shaft 12.

However, unlike in the present embodiment, the cam shaft 45 may be provided on the opposite side from the insertion direction side (the tray leading end side) of the top level side tray 60 in relation to the rotating shaft 12.

The embodiment described above is configured such that the two trays, the bottom level side tray 50 and the top level side tray 60, are provided, and of these, at least the top level side tray 60 causes the cam shaft 45 to rotate; however, a configuration may be adopted in which instead of the top level side tray 60, the bottom level side tray 50 causes the cam shaft 45 to rotate. In this case, it is preferable that the top level side tray 60 is provided with a separate unit which causes the roller support member 11 to rock.

The embodiment described above is configured such that the two trays, the bottom level side tray 50 and the top level side tray 60, are provided; however, the configuration is not limited thereto, and a configuration may be adopted in which only one tray is provided, or conversely, a greater number of trays may be provided, naturally. At this time, there may be one or a plurality of trays which cause the cam shaft 45 to rotate.

5. Second Embodiment

Hereinafter, description will be given of the second embodiment of the invention with reference to FIG. 20 onward.

The second embodiment differs from the first embodiment in that the cam shaft 45 of the first embodiment described above is caused to rock by the bottom level side tray 50 in addition to the top level side tray 60. In the second embodiment, the holding unit 39, which is described with reference to the first embodiment, is not provided.

In FIG. 20, sign 145 is a cam shaft corresponding to the cam shaft 45 of the first embodiment. Sign 146 is a cam follower portion corresponding to the cam follower portion 46 of the first embodiment. Sign 147 is a cam follower portion corresponding to the cam portion 47 of the first embodiment. The functions of the cam shaft 145, the cam follower portion 146, and the cam portion 147 are the same as in the corresponding configuration already described in the first embodiment.

The second embodiment differs from the first embodiment in that the cam shaft 145 is provided with a second cam follower portion 148 which forms a "third engaging portion".

The second cam follower portion 148 is provided in a position at which it is possible to engage with a leading end portion 150*a* of the bottom level side tray 150. The leading end portion 150*a* of the bottom level side tray 150 is the leading end portion of one side among both sides (both sides in the X direction) of the bottom level side tray 150.

FIG. 20 and FIG. 26 which corresponds to FIG. 20 illustrate a process in which the bottom level side tray 150 is mounted. In this state, although the second cam follower portion 148 is in a state in which the contact with the leading end portion 150*a* of the bottom level side tray 150 is started, the cam portion 147 is not pushing the roller support member 11 (the lever engaging portion 11*d*) upward.

When the bottom level side tray 150 moves from this state toward the mounted position (toward the right direction in FIG. 26), as illustrated in FIG. 21 and FIG. 27 which is a sectional diagram corresponding to FIG. 21, the second cam follower portion 148 is pushed up onto the leading end portion 150*a* of the bottom level side tray 150 and assumes a state of being in contact with the top surfaces of the side walls of the bottom level side tray 150. In this process, the cam shaft 145 rotates, the cam portion 147 pushes the roller support member 11 (the lever engaging portion 11*d*) upward, and the roller support member 11 withdraws upward from a proceeding-withdrawing region of the bottom level side tray 150.

In this state, the roller support member 11 is apt to drop downward under its own weight; however, the actions of the cam portion 147, the cam shaft 145, and the second cam follower portion 148 cause a posture in which the roller support member 11 is rocked upward to be maintained. In this posture, the feed roller 10 which is supported by the roller support member 11 is in a position in which the feed roller 10 does not come into contact with the paper which is stored in the bottom level side tray 150 (a position in which there is no contact even if the maximum number of sheets are present).

Here, as illustrated in FIG. 22, a recessed portion 150*b* and an inclined surface 150*c* are formed in the top level side tray 60. When the bottom level side tray 150 moves further from the position illustrated in FIGS. 21 and 27 toward the mounted position, as illustrated in FIG. 22 and FIG. 28 which is a sectional diagram corresponding to FIG. 22, the second cam follower portion 148 is guided from the top surface of the side walls of the bottom level side tray 150 to the inclined surface 150*c* and enters the recessed portion 150*b*. Due to the second cam follower portion 148 entering the recessed portion 150*b*, the supporting of the roller support member 11 by the cam portion 147 is released, and it becomes possible for the roller support member 11 to rock downward. In other words, the feed roller 10 which is supported by the roller support member 11 becomes capable of coming into contact with the paper which is stored in the bottom level side tray 150, and it becomes possible to feed paper out from the bottom level side tray 150.

In the process of removing the bottom level side tray 150 from the mounted position (FIGS. 22 and 28), although not depicted in the drawings, the second cam follower portion 148 is guided by the inclined surface 150*c* to the top surface of the side walls of the bottom level side tray 150. Accordingly, the roller support member 11 is pushed upward again, and the feed roller 10 separates from the paper P1 which is stored in the bottom level side tray 150.

When the top level side tray 60 moves from the withdrawn position toward the feed-capable position in a state in which the bottom level side tray 150 is mounted, as illustrated in FIGS. 23 and 29 which is a sectional diagram corresponding to FIG. 23, the leading end portion 60*d* of the top level side tray 60 starts coming into contact with the cam follower portion 146. When the top level side tray 60 moves further toward the feed-capable position, as illustrated in FIG. 24 and FIG. 30 which is a sectional diagram corresponding to FIG. 24, the cam follower portion 146 is pushed up onto the leading end portion 60*d* of the top level side tray 60 and assumes a state of being in contact with the top surface of the top level side tray 60. In this process, the cam shaft 145 rotates, the cam portion 147 further pushes the roller support member 11 (the lever engaging portion 11*d*) upward, and the roller support member 11 withdraws upward from the proceeding-withdrawing region of the top level side tray 60.

In this state, the roller support member 11 is apt to drop downward under its own weight; however, the actions of the cam portion 147, the cam shaft 145, and the cam follower portion 146 cause a posture in which the roller support member 11 is rocked upward to be maintained. In this posture, the feed roller 10 which is supported by the roller support member 11 is in a position in which the feed roller 10 does not come into contact with the paper which is stored in the top level side tray 60 (a position in which there is no contact even if the maximum number of sheets are present).

Here, as illustrated in the first embodiment described above, the recessed portion 60*e* and the inclined surface 60*f* are formed in the top level side tray 60. When the top level side tray 60 moves further from the position illustrated in FIGS. 24 and 30 toward the feed-capable position, as illustrated in FIG. 25 and FIG. 31 which is a sectional diagram corresponding to FIG. 25, the cam follower portion 146 is guided from the top surface of the top level side tray 60 to the inclined surface 60*f* and enters the recessed portion 60*e*. Due to the cam follower portion 146 entering the recessed portion 60*e*, the supporting of the roller support member 11 by the cam portion 147 is released, and it becomes possible for the roller support member 11 to rock downward. In other words, the feed roller 10 which is supported by the roller support member 11 becomes capable of coming into contact with the paper which is stored in the top level side tray 60, and it becomes possible to feed paper out from the top level side tray 60.

In the process in which the top level side tray 60 moves from the feed-capable position (FIGS. 25 and 31) to the withdrawn position, the cam follower portion 146 is guided onto the top surface of the top level side tray 60 by the inclined surface 60*f*. Accordingly, the roller support member 11 is pushed upward again, and the feed roller 10 separates from the paper P2 which is stored in the top level side tray 60.

As described above, in the present embodiment, since both the bottom level side tray 150 and the top level side tray 60 are configured to cause the cam shaft 145 to rotate, it is not necessary to provide a dedicated cam shaft for each of the top and bottom trays, and it is possible to obtain a simplification and a cost reduction in the apparatus configuration.

The second embodiment described above is configured such that the two trays, the bottom level side tray 150 and the top level side tray 60, are provided, and the cam shaft 145 is caused to rotate by these two trays; however, the configuration is not limited thereto, and a configuration may be adopted in which still more trays are provided, and each of the trays causes the cam shaft 145 to rotate, and a configuration may be adopted in which, of the trays, an arbitrary tray (singular or plural) causes the cam shaft 145 to rotate.

The respective cam portion (47, 147) and cam follower portion (46, 146, 148) of the first embodiment and the second embodiment are provided on only one side in the axial direction of the cam shaft (45, 145) in the present embodiment; however, the cam portion and the cam follower portion may additionally be provided on the other side, that is, may be provided as pairs symmetrically on the left and right.

The invention is not limited to the embodiments described above or the modification examples described as appropriate, and may be modified in various ways within the scope of the invention described in the claims, and the modifications should be construed as being included in the invention.

The entire disclosure of Japanese Patent Application No. 2015-206995, filed Oct. 21, 2015 is expressly incorporated by reference herein.

What is claimed is:

1. A recording apparatus comprising:

a recording unit which performs recording on a recording medium;

a tray which stores the recording medium;

a tray storage portion which stores the tray;

a feed roller which feeds the recording medium out from the tray; and a roller support member which supports the feed roller and causes the feed roller to be lifted and lowered in relation to the tray by changing posture, wherein a cam shaft configured to rotate is provided in the tray storage portion, wherein the cam shaft is provided with a first engaging portion which engages with the tray and a second engaging portion which engages with the roller support member and connects the cam shaft to the roller support member, and wherein the roller support member is configured to change posture due to the tray causing the cam shaft to rotate.

2. The recording apparatus according to claim 1, wherein the roller support member is configured to be rocked by a rocking shaft and to cause the feed roller to be lifted or lowered in relation to the tray by be rocked by the rocking shaft, and wherein the cam shaft is a separate member from the rocking shaft.

3. The recording apparatus according to claim 2, wherein the cam shaft is positioned on an insertion direction side of the tray in relation to the rocking shaft in the insertion-removal direction of the tray in relation to the tray storage portion.

4. The recording apparatus according to claim 1, wherein a distance from an engagement position between the tray and the first engaging portion to a rotational center of the cam shaft is longer than a distance from an engagement position between the roller support member and the second engaging portion to the rotational center.

5. The recording apparatus according to claim 1, wherein, when the tray pushes the roller support member upward, a height direction displacement amount of the engagement position between the roller support member and the second engaging portion per predetermined rotational angle of the cam shaft is greater than a height direction displacement amount of the engagement position between the tray and the first engaging portion.

6. The recording apparatus according to claim 1, wherein a plurality of the trays are provided.

7. A recording apparatus comprising:

a recording unit which performs recording on a recording medium;

a bottom level side tray which stores the recording medium;

a top level side tray which is provided above the bottom level side tray and stores the recording medium;

a tray storage portion which stores the bottom level side tray and the top level side tray;

a feed roller which feeds the recording medium out from the top level side tray and the bottom level side tray; and a roller support member which supports the feed roller and causes the feed roller to be lifted and lowered in relation to the bottom level side tray and the top level side tray by changing posture, wherein a cam shaft configured to rotate is provided in the tray storage portion, wherein the cam shaft is provided with a first engaging portion which engages with either or both of the bottom level side tray and the top level side tray and a second engaging portion which engages with the roller support member, and wherein the roller support member is configured to change posture due to either or both of the bottom level side tray and the top level side tray causing the cam shaft to rotate.

8. The recording apparatus according to claim 7, wherein the first engaging portion engages with the top level side tray, wherein the cam shaft is provided with a third engaging portion which engages with the bottom level side tray, and wherein both the bottom level side tray and the top level side tray are configured to cause the cam shaft to rotate.

* * * * *